US012397980B2

(12) United States Patent
Kang et al.

(10) Patent No.: US 12,397,980 B2
(45) Date of Patent: Aug. 26, 2025

(54) TRAY FOR DISPLAY PANEL

(71) Applicant: Samsung Display Co., LTD., Yongin-si (KR)

(72) Inventors: Tae Gil Kang, Yongin-si (KR); Byung Jin Kim, Yongin-si (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 118 days.

(21) Appl. No.: 18/116,458

(22) Filed: Mar. 2, 2023

(65) Prior Publication Data

US 2023/0322463 A1 Oct. 12, 2023

(30) Foreign Application Priority Data

Jul. 14, 2022 (KR) ..... 10-2022-0086839

(51) Int. Cl.
*B65D 81/02* (2006.01)
*B65D 81/05* (2006.01)
*B65D 85/38* (2006.01)

(52) U.S. Cl.
CPC ..... *B65D 81/022* (2013.01); *B65D 81/053* (2013.01); *B65D 85/38* (2013.01); *B65D 2581/051* (2013.01); *B65D 2585/6837* (2013.01)

(58) Field of Classification Search
CPC .. B65D 81/022; B65D 81/053; B65D 81/054; B65D 85/38; B65D 85/30; B65D 71/04; B65D 2851/051
USPC ..... 206/521, 586, 587, 591, 592, 453, 454, 206/722, 455, 449
See application file for complete search history.

(56) References Cited

U.S. PATENT DOCUMENTS

| | | | | |
|---|---|---|---|---|
| 7,648,750 | B2 * | 1/2010 | Sattora | B65D 81/113 206/588 |
| 8,757,421 | B2 * | 6/2014 | Yang | B65D 81/3216 220/521 |
| 10,392,176 | B1 * | 8/2019 | Hu | B65D 85/48 |
| 10,906,718 | B2 | 2/2021 | Sim et al. | |
| 2002/0144923 | A1 * | 10/2002 | Baechle | B65D 81/054 428/36.9 |
| 2013/0306514 | A1 * | 11/2013 | Hu | B65D 81/053 206/586 |
| 2020/0122913 | A1 * | 4/2020 | Sim | B65D 85/30 |

(Continued)

FOREIGN PATENT DOCUMENTS

| | | |
|---|---|---|
| KR | 20-2015-0000685 | 2/2015 |
| KR | 10-1633117 | 6/2016 |
| KR | 10-2020-0044262 | 4/2020 |

*Primary Examiner* — Rafael A Ortiz
(74) *Attorney, Agent, or Firm* — CANTOR COLBURN LLP

(57) ABSTRACT

A tray for a display panel includes a body part including a base and an outer wall disposed to surround the base, and a slot part including a support member extending in a first direction and a second direction intersecting the first direction, and at least one buffer member disposed on an inner lateral side of the support member, wherein the at least one buffer member includes a plurality of buffer portions, each including airgaps, and a plurality of pillar portions, each disposed between adjacent ones of the plurality of buffer portions, the at least one buffer member includes a first surface, which is in contact with the support member, and a second surface, which faces the first surface, and the second surface has a convex shape in a plan view.

9 Claims, 30 Drawing Sheets

(56) References Cited

U.S. PATENT DOCUMENTS

2020/0172315 A1* 6/2020 Hu ..... B65D 81/113
2021/0269218 A1* 9/2021 Uchida ..... B65D 81/05

* cited by examiner

1000_1

TRAY FOR DISPLAY PANEL

CROSS-REFERENCE TO RELATED APPLICATION(S)

This application claims priority to and benefits of Korean Patent Application No. 10-2022-0086839 under 35 U.S.C. 119, filed on Jul. 14, 2022, in the Korean Intellectual Property Office (KIPO), the entire contents of which are incorporated herein by reference.

BACKGROUND

1. Technical Field

The disclosure relates to a tray for a display panel.

2. Description of the Related Art

Display devices have increasingly become of importance with the development of multimedia, and various types of display devices, such as a liquid crystal display (LCD) device, an organic light-emitting diode (OLED) display device, or the like, have been used.

The LCD device includes an LCD panel, which displays an image using the light transmittance of liquid crystal molecules, and the OLED display device includes an OLED display panel.

The LCD panel may include a polarizing plate thereon, and the OLED display panel may include an anti-reflective film thereon. The polarizing plate or the anti-reflective film may be attached to a lower substrate via an adhesive material, in which case, the LCD panel or the OLED display panel may be readily peeled off or damaged by external shock while being stored or transferred.

To prevent damage to a display panel, the display panel may be carried around in a tray where storage space is formed. Multiple display panels may be stored and carried around in a state of being stacked in the tray.

A tray for a display panel is formed of a Styrofoam material such as expanded polystyrene (EPS) or expanded polypropylene (EPP). However, a Styrofoam tray for a display panel has a relatively low impact resistance. Thus, multiple slots may be disposed in a tray for a display panel to correspond to the corners of a display panel. The slots can minimize the mobility of a display panel in the tray for a display panel and can thus prevent the display panel from being damaged by external shock.

SUMMARY

Aspects of the disclosure provide a tray for a display panel, which is capable of minimizing external shock applied to a display panel.

Aspects of the disclosure also provide a tray for a display panel, which is capable of minimizing the abrasion of slots.

However, aspects of the disclosure are not restricted to those set forth herein. The above and other aspects of the disclosure will become more apparent to one of ordinary skill in the art to which the disclosure pertains by referencing the detailed description of the disclosure given below.

According to an aspect of the disclosure, a tray for a display panel may include a body part including a base and an outer wall disposed to surround the base, and a slot part including a support member extending in a first direction and a second direction intersecting the first direction, and at least one buffer member disposed on an inner lateral side of the support member. The at least one buffer member may include a plurality of buffer portions, each including airgaps, and a plurality of pillar portions, each disposed between adjacent ones of the plurality of buffer portions. The at least one buffer member may include a first surface, which is in contact with the support member, and a second surface, which faces the first surface. The second surface may have a convex shape in a plan view.

In an embodiment, a portion the at least one buffer member overlapping the plurality of pillar portion in the first direction or the second direction may not directly contact a display panel.

In an embodiment, the at least one buffer member may further include a third surface, which is different from the first and second surfaces, and a fourth surface, which faces the third surface, and the airgaps may be formed of through holes extending from the third surface to the fourth surface.

In an embodiment, the at least one buffer member may further include a third surface, which is different from the first and second surfaces, and a fourth surface, which faces the third surface, and the airgaps may be formed of pocket-type airgaps extending in a direction from the third surface to the fourth surface, penetrating the fourth surface, and not penetrating the third surface.

In an embodiment, the support member may include a first support portion extending in the first direction and a second support portion extending in the second direction and intersecting the first support portion, and the at least one buffer member may include a first buffer member disposed on an inner lateral side of the first support portion and a second buffer member disposed on an inner lateral side of the second support portion.

In an embodiment, an edge of the first buffer member and an edge of the second buffer member may contact each other.

In an embodiment, an end of the first buffer member may protrude beyond an end of the first support portion.

In an embodiment, an end of the first support portion may protrude beyond an end of the first buffer member.

According to an embodiment of the disclosure, the tray for a display panel may include a body part including a base and an outer wall disposed to surround the base, and a slot part including a support member extending in a first direction and a second direction intersecting the first direction, and a buffer member disposed on an inner lateral side of the support member. The buffer member may include a plurality of buffer portions, each including airgaps, and a plurality of pillar portions, each disposed between adjacent ones of the plurality of buffer portions. Each of the plurality of buffer portions and the plurality of pillar portions may extend in the first or second direction.

In an embodiment, each of the plurality of pillar portions may be arranged to be offset from a display panel in a lateral direction of the display panel.

In an embodiment, the buffer member may be integrally bonded to the support member.

In an embodiment, the buffer member may include a first surface and a second surface, which are disposed perpendicular to a direction the airgaps extend, and the airgaps may be pocket-type airgaps penetrating the first surface, and not penetrating the second surface.

In an embodiment, the outer wall may include first coupling grooves disposed on inner lateral sides of the outer wall, the base may include second coupling grooves disposed on a top surface of the base, the support member may include support portions and coupling portions, the first coupling grooves may be coupled to the coupling portions, and the second coupling grooves may be coupled to the support portions and the buffer member.

In an embodiment, the first coupling grooves and the second coupling grooves may be deeper than the top surface of the base in a third direction intersecting the first and second directions.

According to an embodiment of the disclosure, a tray for a display panel may include a body part including a base and an outer wall disposed to surround the base, and a slot part including a support member extending in a first direction and a second direction intersecting the first direction, and a buffer member disposed on an inner lateral side of the support member. The buffer member may include a plurality of buffer portions, each including airgaps, and a plurality of pillar portions, each disposed between adjacent ones of the plurality of buffer portions. Each of the plurality of buffer portions and the plurality of pillar portions may extend in a third direction intersecting the first and second directions, and the buffer member may be integrally bonded to the support member.

In an embodiment, the buffer member may include a first surface, and an entire area of the first surface may contact the support member.

In an embodiment, a hardness of the support member may be greater than a hardness of the buffer member.

In an embodiment, a Shore-A hardness of the buffer member may be in a range of about 80 to about 95.

In an embodiment, the support member may include polycarbonate, and the buffer member may include urethane.

In an embodiment, the body part may further include a receiving area that receives a display panel, and the receiving area may be disposed on the base inside of inner lateral sides of the outer wall in a plan view.

According to the aforementioned and other embodiments of the disclosure, external shock applied to a display panel may be minimized.

Also, the abrasion of slots may be minimized.

It should be noted that the effects of the disclosure are not limited to those described above, and other effects of the disclosure will be apparent from the following description.

BRIEF DESCRIPTION OF THE DRAWINGS

The above and other aspects and features of the disclosure will become more apparent by describing in detail embodiments thereof with reference to the attached drawings, in which.

DETAILED DESCRIPTION OF THE EMBODIMENTS

The disclosure will now be described more fully hereinafter with reference to the accompanying drawings, in which embodiments of the disclosure are shown. This disclosure may, however, be embodied in different forms and should not be construed as limited to the embodiments set forth herein. Rather, these embodiments are provided so that this disclosure will be thorough and complete, and will fully convey the scope of the disclosure to those skilled in the art.

When an element, such as a layer, is referred to as being "on", "connected to", or "coupled to" another element or layer, it may be directly on, connected to, or coupled to the other element or layer or intervening elements or layers may be present. When, however, an element or layer is referred to as being "directly on", "directly connected to", or "directly coupled to" another element or layer, there are no intervening elements or layers present. To this end, the term "connected" may refer to physical, electrical, and/or fluid connection, with or without intervening elements. Also, when an element is referred to as being "in contact" or "contacted" or the like to another element, the element may be in "electrical contact" or in "physical contact" with another element; or in "indirect contact" or in "direct contact" with another element. The same reference numbers indicate the same components throughout the specification.

Unless otherwise defined or implied herein, all terms (including technical and scientific terms) used have the same meaning as commonly understood by those skilled in the art to which this disclosure pertains. It will be further understood that terms, such as those defined in commonly used dictionaries, should be interpreted as having a meaning that is consistent with their meaning in the context of the relevant art and should not be interpreted in an ideal or excessively formal sense unless clearly defined in the specification.

Embodiments of the disclosure will hereinafter be described with reference to the accompanying drawings.

Figure 1:
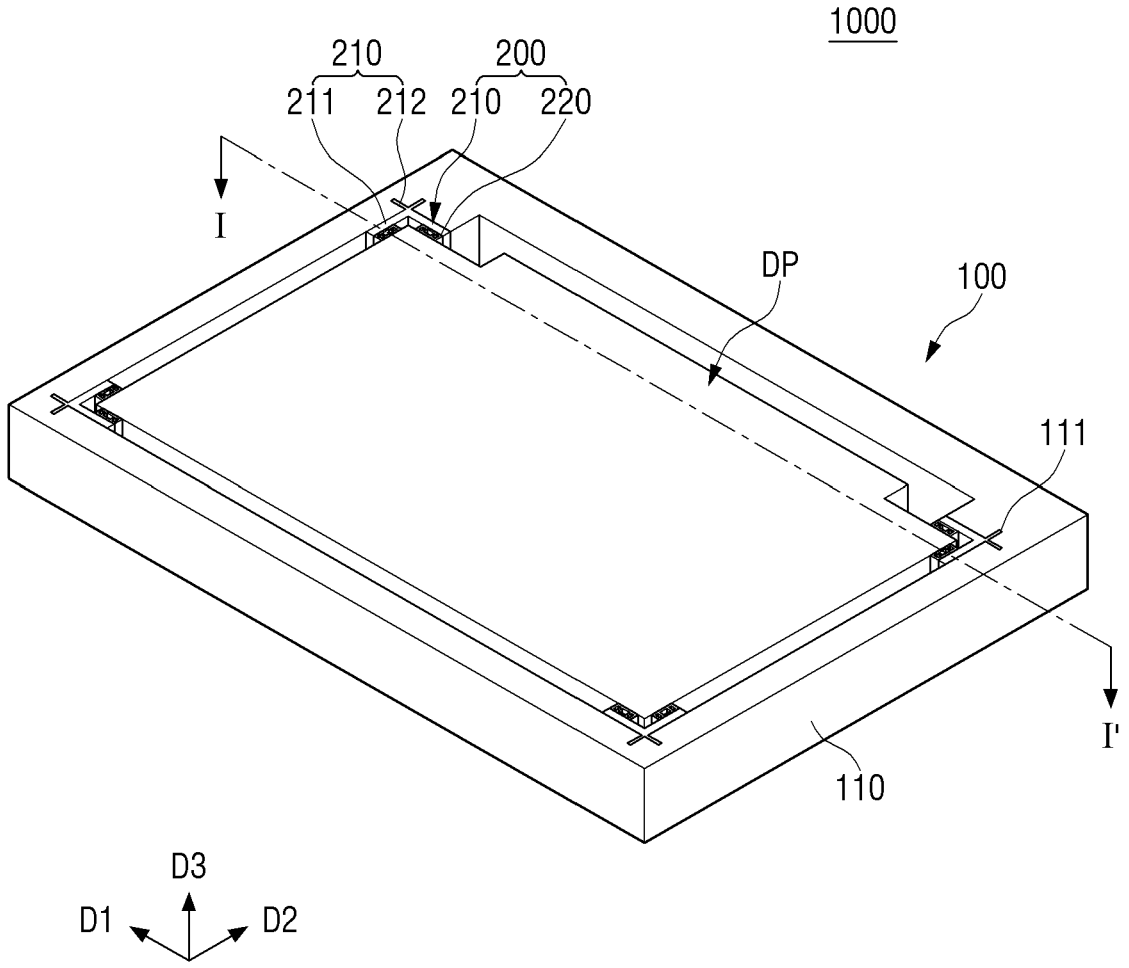
FIG. 1 is a perspective view of a tray for a display panel according to an embodiment of the disclosure.
Figure 2:
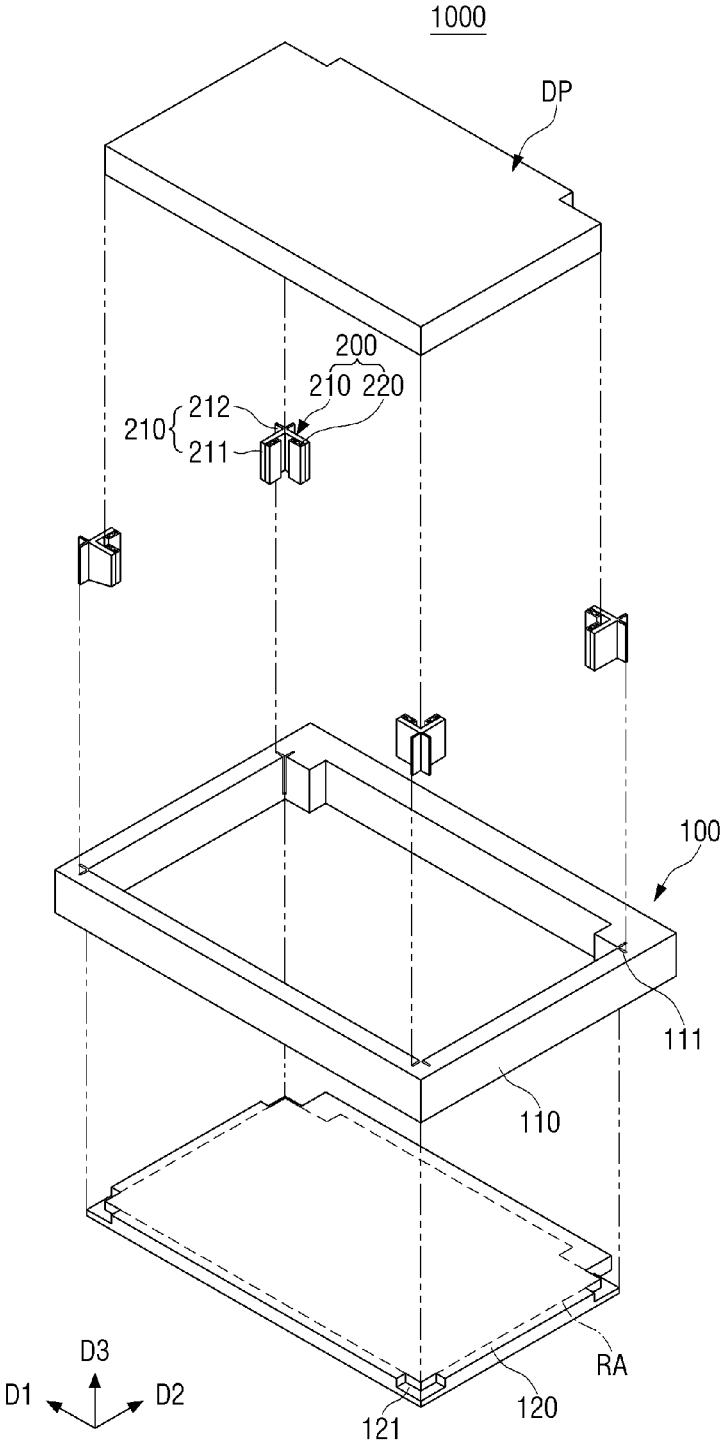
FIG. 2 is an exploded perspective view of the tray for a display panel according to an embodiment of the disclosure.
Figure 3:
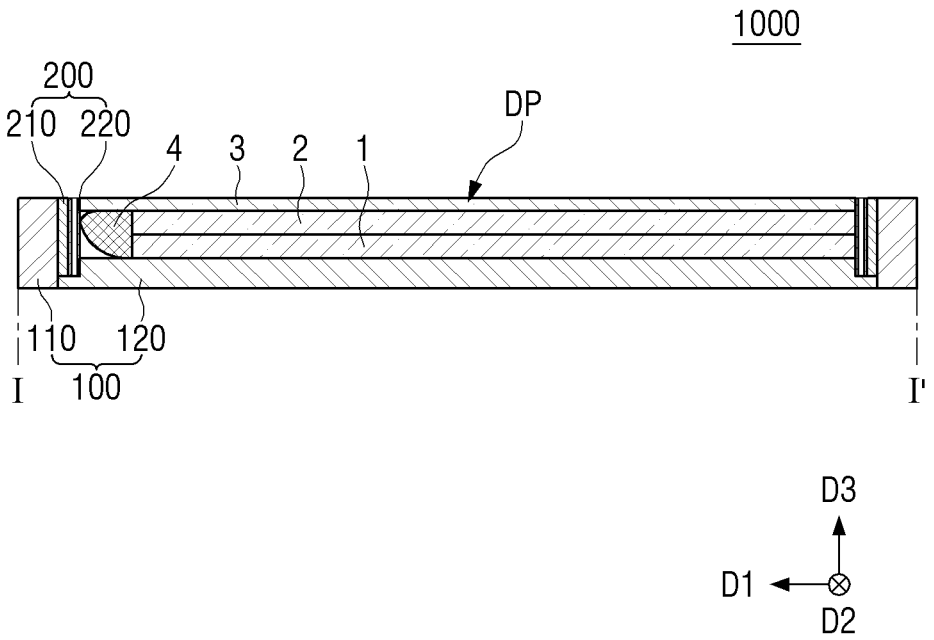
FIG. 3 is a schematic cross-sectional view taken along line I-I' of FIG. 2.
Figure 4:
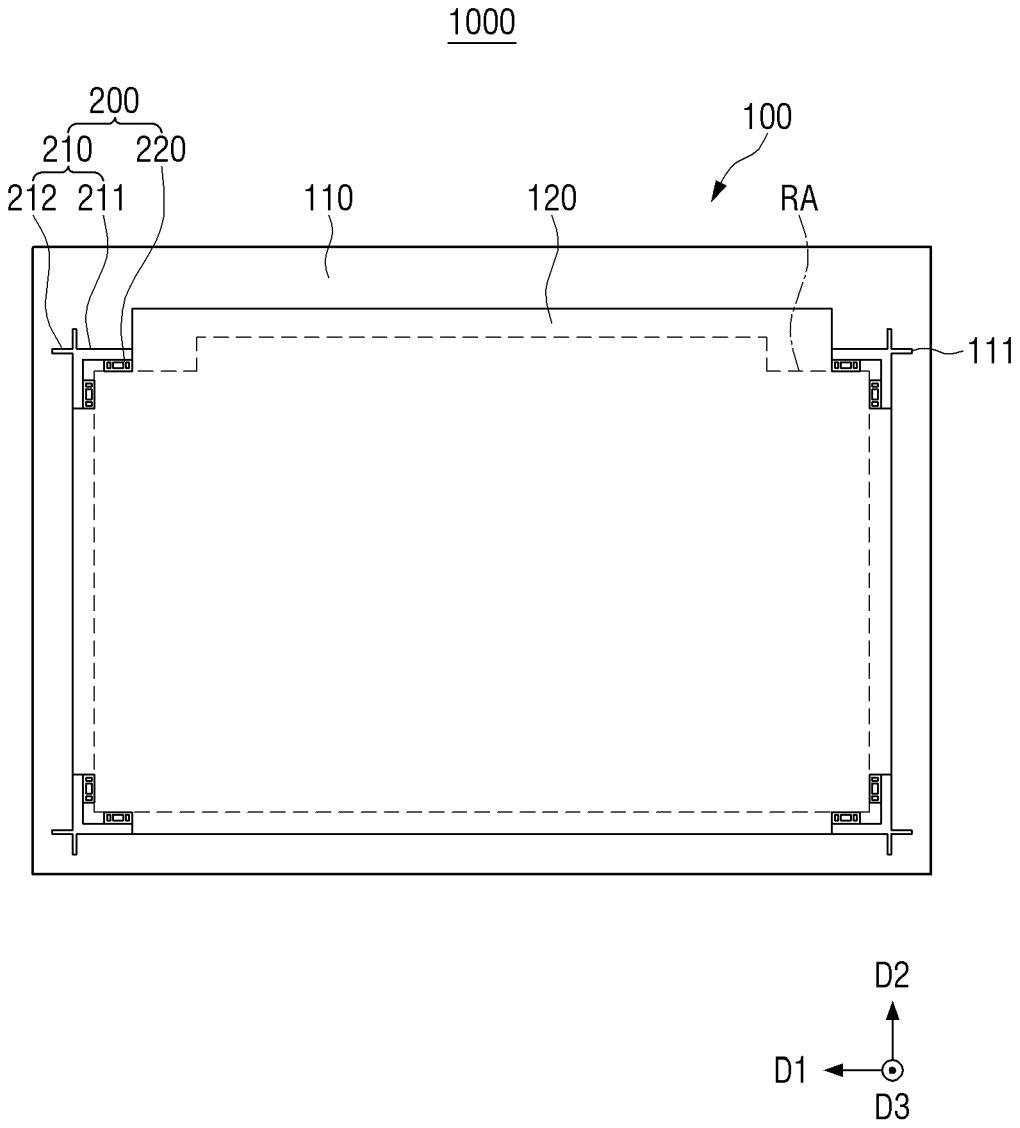
FIG. 4 is a plan view of the tray for a display panel according to an embodiment of the disclosure.

FIG. 1 is a perspective view of a tray for a display panel according to an embodiment of the disclosure. FIG. 2 is an exploded perspective view of the tray for a display panel according to an embodiment of the disclosure. FIG. 3 is a schematic cross-sectional view taken along line I-I' of FIG. 2. FIG. 4 is a plan view of the tray for a display panel according to an embodiment of the disclosure.

Referring to FIGS. 1 through 4, first and second directions D1 and D2 may intersect each other. For example, the first and second directions D1 and D2 may perpendicularly intersect each other. A third direction D3 may be, for example, a direction perpendicularly intersecting the first and second directions D1 and D2.

A tray 1000 for a display panel may receive a display panel DP therein for the purpose of transporting and storing the display panel DP.

The display panel DP may be one of a liquid crystal display (LCD) panel, an electrophoretic display panel, a microelectromechanical system (MEMS) display panel, an electrowetting display panel, an organic light-emitting display panel, a micro-light-emitting diode (microLED) display panel, a quantum-dot display panel, and a quantum-rod display panel, but the type of the display panel DP is not particularly limited.

The display panel DP may include a lower substrate 1, an upper substrate 2, an optical member 3, and a seal member 4. The lower substrate 1 may include switching elements such as thin-film transistors (TFTs) and other members for driving the switching elements. The upper substrate 2 may include members for display colors on the display panel DP, such as a color conversion layer and a color filter layer. The optical member 3 may be a polarizing plate in case that the display panel is an LCD panel or may be an anti-reflective film in case that the display panel DP is an organic light-emitting display panel.

Although not specifically illustrated, the display panel DP may further include a window member, a driving member, a protective member, a backlight member, and a chassis. The window member may include a window glass and a window base layer. The driving member may include a circuit board (e.g., a driving circuit board) for driving the display panel DP. The protective member may include a protective film, a heat dissipation film, and a metal plate. The display panel DP may further include a light emitting device below the display panel DP if the display panel DP is an LCD panel. The light emitting device may include a light source and a light guide plate.

The shape of the display panel DP is not particularly limited. The display panel DP is illustrated as a flat display panel, but the disclosure is not limited thereto. In another embodiment, the display panel DP may be a curved display panel.

The tray 1000 may include a body part 100 and multiple slot parts 200. The body part 100 may include a receiving area RA in which the display panel DP may be disposed. The slot parts 200 may be disposed to face the lateral sides of the display panel DP in the receiving area RA and may thus prevent the display panel DP from being damaged by external shock.

The body part 100 may include a base 120 and an outer wall 110, which is disposed along the outer circumference of the base 120.

The base 120 may provide a space in which the display panel DP may be disposed. The shape of the base 120 may be the same as, or conform to, the shape of the display panel DP.

The outer wall 110 may be disposed along the circumference of the base 120. The outer wall 110 may be disposed to surround the base 120, in a plan view. The outer wall 110 may have a predetermined (or selectable) height and thickness.

The outer lateral sides of the outer wall 110 may have a rectangular shape in a plan view. For example, the outer lateral sides of the outer wall 110 may have a rectangular shape having long sides extending in the first direction D1 and short sides extending in the second direction D2. The corners at which the long sides and the short sides of each of the outer lateral sides of the outer wall 110 meet may be right-angled or may be rounded with a predetermined (or selectable) curvature. However, the shape of the outer lateral sides of the outer wall 110 is not particularly limited, and the outer lateral sides of the outer wall 110 may have various other shapes such as another polygonal shape, a circular shape, or an elliptical shape. The shape of the inner lateral sides of the outer wall 110 may vary depending on the shape of the display panel DP. For example, the outer wall 110 may include receiving grooves, which are inwardly recessed to receive the circuit board of the display panel DP.

The outer wall 110 may include first coupling grooves 111. The first coupling grooves 111 may be disposed on the inner lateral sides of the outer wall 110. The first coupling grooves 111 may be configured to be coupled to coupling portions 212 of support members 210 of the slot parts 200.

The base 120 may include second coupling grooves 121. The second coupling grooves 121 may be disposed on the top surface of the base 120. The second coupling grooves 121 may be configured to be coupled to support portions 211 of the support members 210 of the slot parts 200 and buffer members 220 of the slot parts 200.

As the body part 100 is provided with the first coupling grooves 111 and the second coupling grooves 121, the slot parts 200 may be coupled to, or decoupled from, the body part 100 via the first coupling grooves 111 and the second coupling grooves 121. As the slot parts 200 can be freely coupled to, or decoupled from, the tray 1000 via the first coupling grooves 111 and the second coupling grooves 121, without regard to the size and the shape of the tray 1000, the slot parts 200 may be readily replaced and used.

The thickness and the height of the first coupling grooves 111 and the thickness and the height of the coupling portions 212 of the support members 210 of the slot parts 200 may be substantially the same. The thickness of the second coupling grooves 121 and the sum of the thickness of the support members 210 of the slot parts 200 and the thickness of the buffer members 220 of the slot parts 200 may be substantially the same. For example, the first coupling grooves 111 and the second coupling grooves 121 may be formed deeper than the top surface of the base 120 in the third direction D3. For example, the first coupling grooves 111 and the second coupling grooves 121 may be formed to penetrate a plane extended in the first and second directions D1 and D2 from the top surface of the base 120. As a result, the slot parts 200 may be firmly coupled to the body part 100.

The outer wall 110 of the body part 100 may define the receiving area RA where the display panel DP can be received, together with the base 120. The receiving area RA may be positioned in the space surrounded by the outer wall 110, on the top surface of the base 120. The receiving area RA may have the same area as, or a larger area than, the display panel DP, which is received in the receiving area RA. The shape of the receiving area RA may vary depending on the shape of the display panel DP.

The boundaries (or edges) of the receiving area RA may be positioned inside of the outer wall 110 in a plan view. For example, the boundaries of the receiving area RA may coincide with the inner boundaries of the buffer members 220 of the slot parts 200 or may be positioned inside of the inner boundaries of the buffer members 220 of the slot parts 200 in a plan view. The lateral sides of the display panel DP may only contact the slot parts 200, but not the outer wall 110. Thus, the display panel DP may be prevented from colliding with the outer wall 110 due to external shock, and the stress applied to the display panel DP may be minimized by the buffer members 220.

In some embodiments, the body part 100 may be formed of Expanded polystyrene (EPS), Expanded polypropylene (EPP), or a mixture thereof. In case that the body part 100 is formed of a Styrofoam material such as EPS or EPP, the body part 100 may have a relatively low impact resistance. However, as the tray 1000 includes the slot parts 200, which have a shock absorbing function, external shock may be prevented from being directly delivered to the display panel DP through the body part 100, which has a relatively low impact resistance.

The slot parts 200 may be disposed on the inner lateral sides of the outer wall 110 of the body part 100. The slot parts 200 may be disposed near the corners of the body part 100. The number and the locations of the slot parts 200 are not particularly limited. For example, four slot parts 200 may be disposed at the corners of the tray 1000 to contact the inner lateral sides of the outer wall 110.

The slot parts 200 may be coupled to the body part 100 through the first coupling grooves 111 and the second coupling grooves 121. The coupling portions 212 of the support members 210 of the slot parts 200 may be coupled to the first coupling grooves 111 of the outer wall 110, and the support members 210 and the buffer members 220 of the slot parts 200 may be coupled to the second coupling grooves 121 of the base 120. The slot parts 200 may be fitted and fixed to the body part 100 through the first coupling grooves 111 and the second coupling grooves 121.

The slot parts 200 will hereinafter be described with reference to FIGS. 5 through 12.

Figure 5:
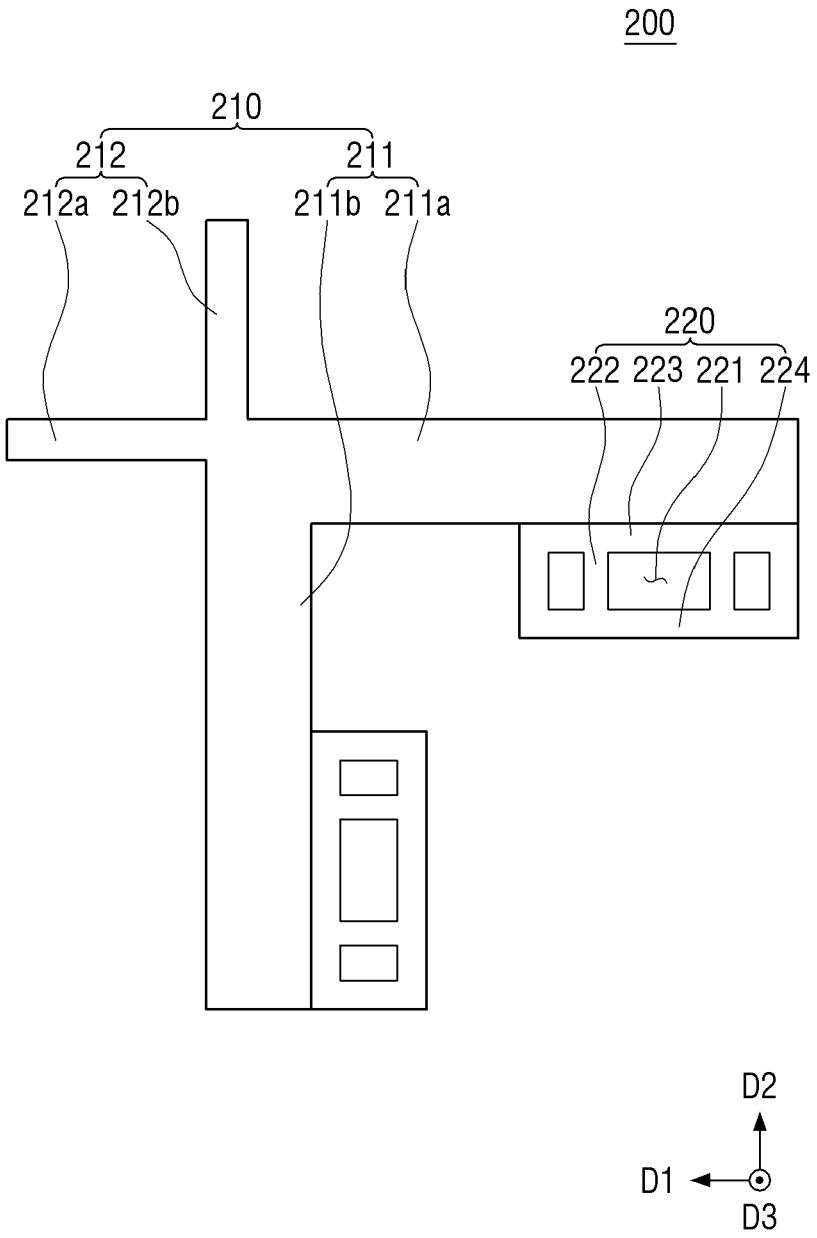
FIG. 5 is an enlarged plan view of a slot part according to an embodiment of the disclosure.
Figure 6:
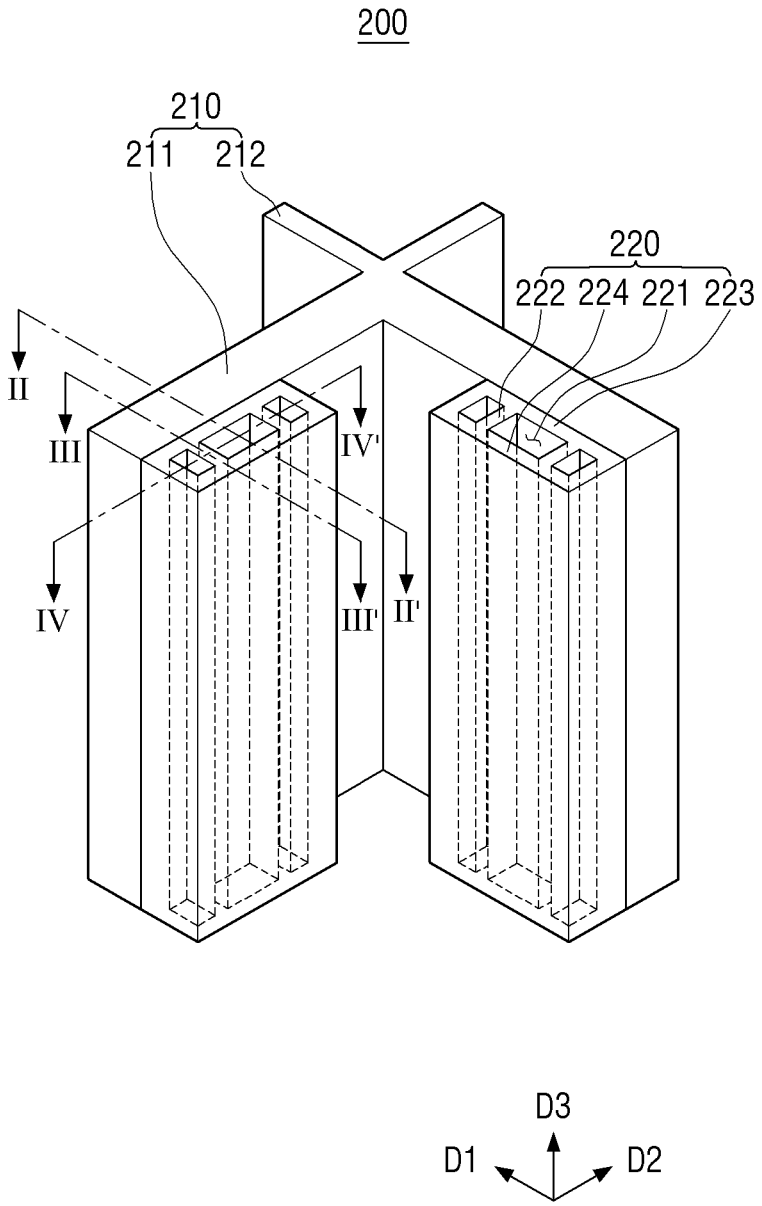
FIG. 6 is an enlarged perspective view of the slot part of FIG. 5.
Figure 7:
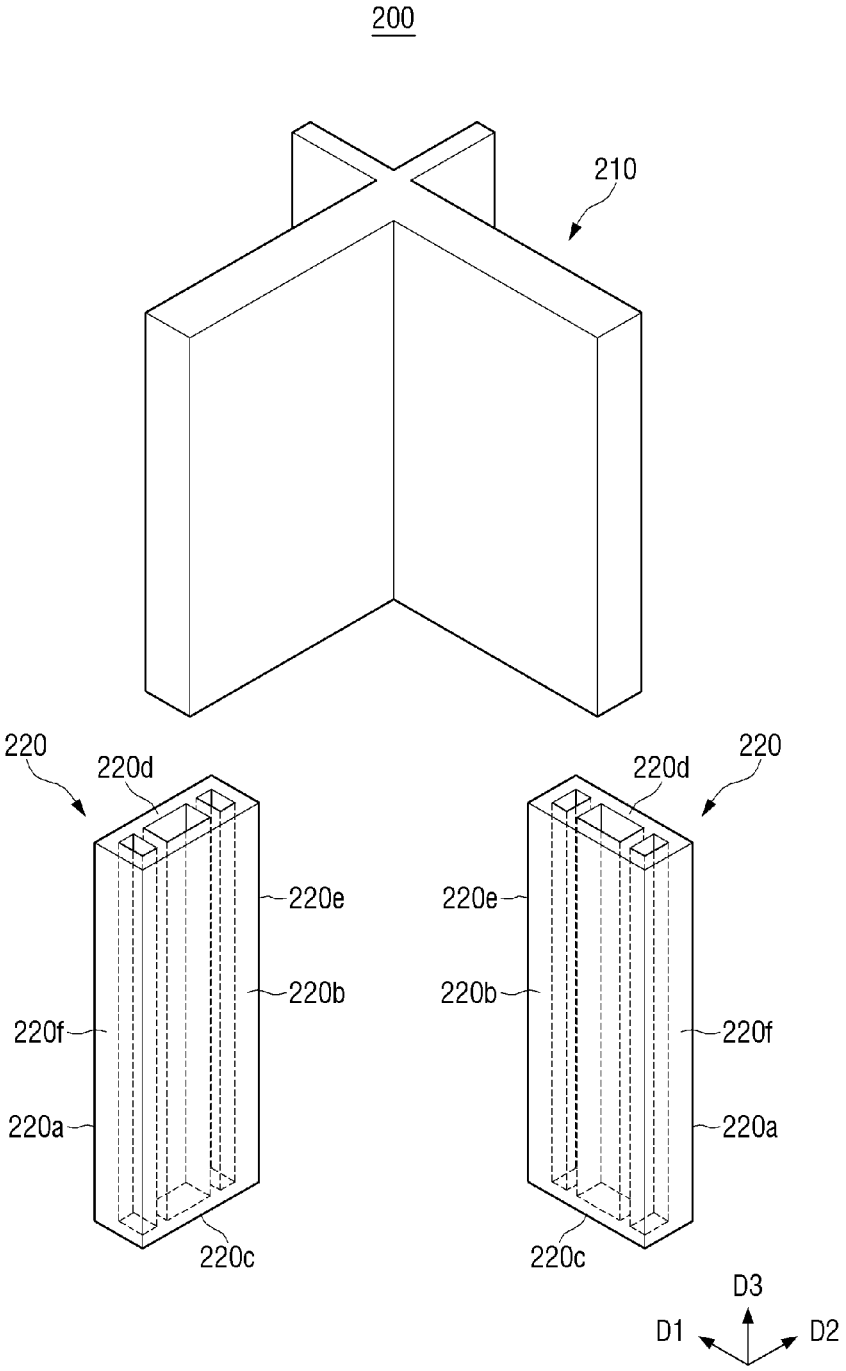
FIG. 7 is an exploded perspective view of the slot part of FIG. 5 for explaining lateral sides of each buffer member.
Figure 8:
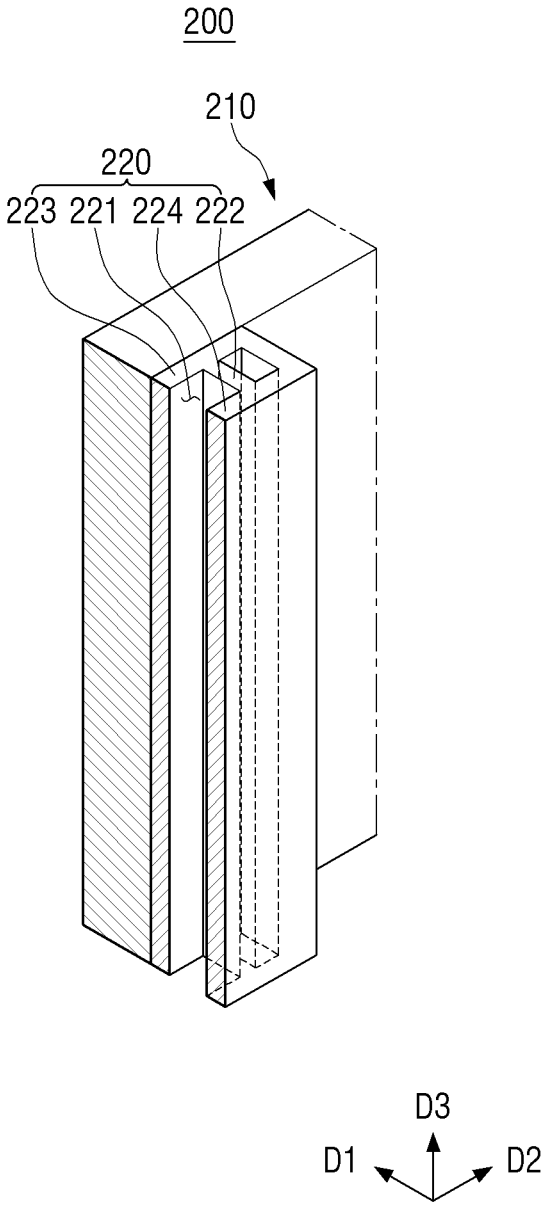
FIG. 8 is a schematic cross-sectional perspective view of the slot part of FIG. 6 taken along line II-II'.
Figure 9:
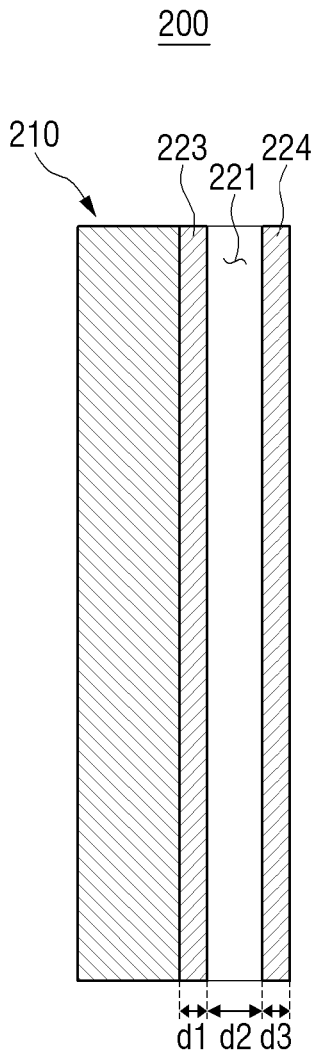
FIG. 9 is a schematic cross-sectional view taken along line II-II' of FIG. 6.
Figure 10:
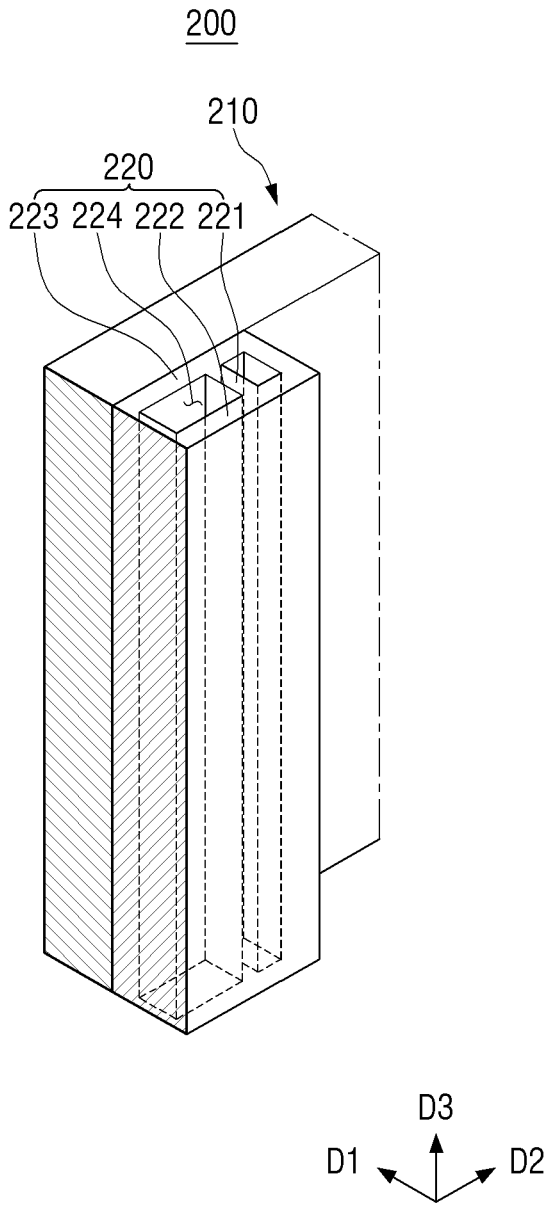
FIG. 10 is a schematic cross-sectional perspective view of the slot part of FIG. 6 taken along line III-III'.
Figure 11:
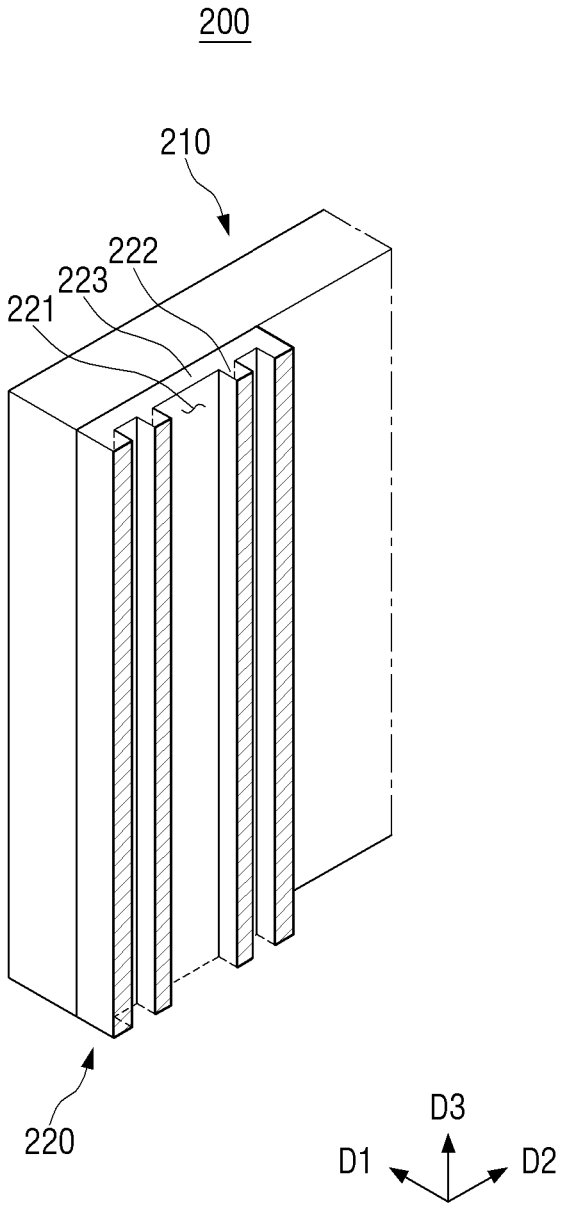
FIG. 11 is a schematic cross-sectional perspective view of the slot part of FIG. 6 taken along line IV-IV'.
Figure 12:
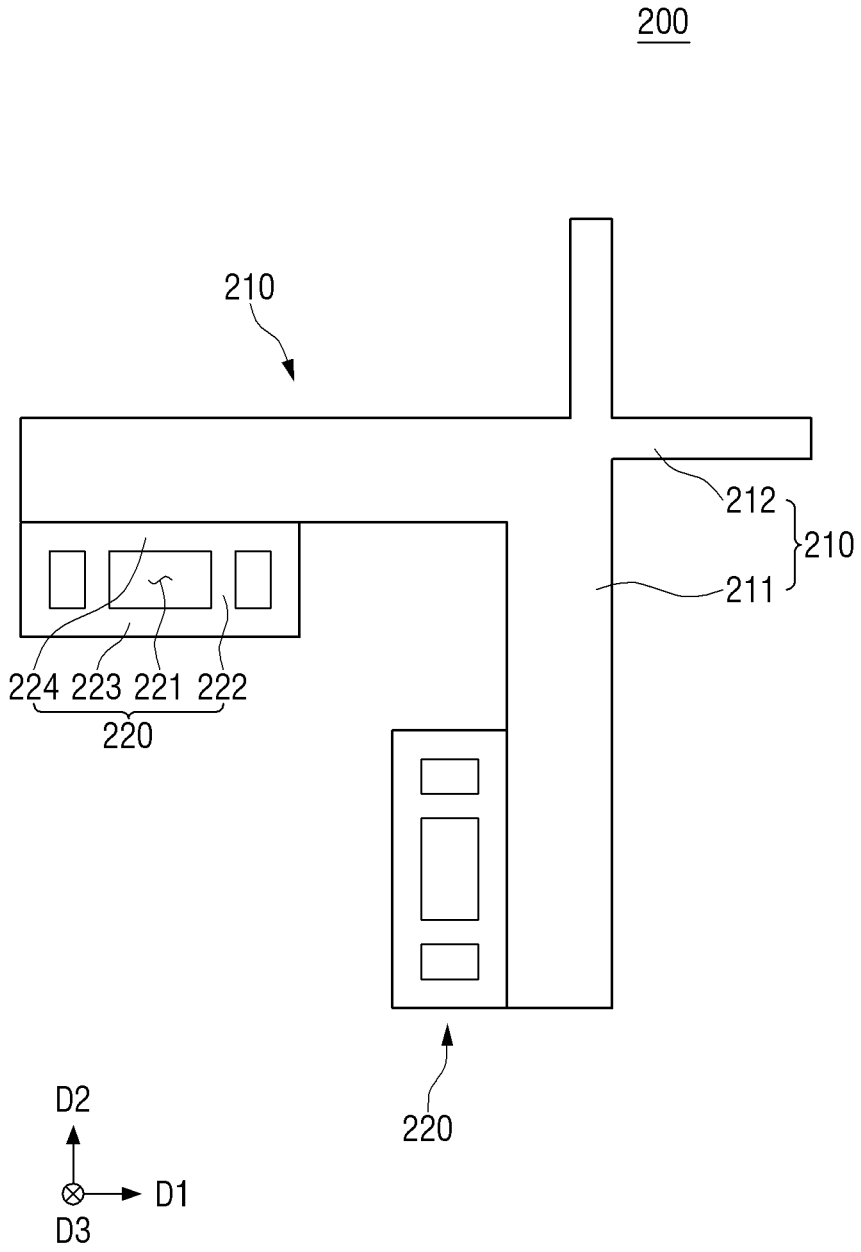
FIG. 12 is a bottom view of the slot part of FIG. 5.

FIG. 5 is an enlarged plan view of a slot part according to an embodiment of the disclosure. FIG. 6 is an enlarged perspective view of the slot part of FIG. 5. FIG. 7 is an exploded perspective view of the slot part of FIG. 5 for explaining lateral sides of each buffer member. FIG. 8 is a schematic cross-sectional perspective view of the slot part of FIG. 6 taken along line II-II'. FIG. 9 is a schematic cross-sectional view taken along line II-II' of FIG. 6. FIG. 10 is a schematic cross-sectional perspective view of the slot part of FIG. 6 taken along line III-III'. FIG. 11 is a schematic cross-sectional perspective view of the slot part of FIG. 6 taken along line IV-IV'. FIG. 12 is a bottom view of the slot part of FIG. 5.

Referring to FIGS. 5 through 12, a slot part 200 may include a support member 210 and one or more buffer members 220, which are disposed on the support member 210.

The support member 210 may include a support portion 211 and a coupling portion 212, which are L-shaped. The support portion 211 may include first and second support portions 211*a* and 211*b*, which extend in the first and second directions D1 and D2, respectively. The support portion 211 may be configured such that the buffer members 220 may be bonded to a surface of the support portion 211. The coupling portion 212 may include first and second coupling portions 212*a* and 212*b*, which extend in the first and second directions D1 and D2, respectively. The coupling portion 212 may be coupled to the first coupling groove 111 of the outer wall 110. The thickness and the height of the coupling portion 212 and the thickness and the height of the first coupling groove 111 may be substantially the same. Thus, the slot part 200 may be stably fixed to the body part 100.

The buffer members 220 may control the mobility of the display panel DP and absorb and relieve impact that may be generated upon the movement of the display panel DP. The buffer members 220 may be disposed directly on the inner lateral sides of the support portion 211 of the support member 210. Each of the buffer members 220 may include a first buffer portion, which is disposed on the inner lateral side of the first support portion 211*a*, and a second buffer portion, which is disposed on the inner lateral side of the second support portion 211*b*.

In some embodiments, the buffer members 220 may be bonded to the support portion 211 of the support member 210. The buffer members 220 is illustrated as having a cuboid shape in FIG. 5-8, but the shape of the buffer members 220 is not particularly limited.

Each of the buffer members 220 may include multiple buffer portions 221, multiple pillar portions 222, a bonding portion 223, and a panel contact portion 224. The buffer portions 221 may be disposed between the bonding portion 223 and the panel contact portion 224. The buffer portions 221 may include airgaps, which are in the form of through holes or pockets. The pillar portions 222 may be disposed between the buffer portions 221 to connect the bonding portion 223 and the panel contact portion 224. The bonding portion 223 may be disposed on, and in direct contact with, the support portion 211 of the support member 210. The buffer member 220 may be bonded to the support member 210 through the bonding portion 223. The panel contact portion 224 may be disposed on the opposite side of the bonding portion 223 with respect to the buffer portions 221 and the pillar portions 222, which are interposed between the panel contact portion 224 and the bonding portion 223. The panel contact portion 224 may be configured to be in direct contact with the display panel DP.

Referring to FIG. 7, each of the buffer members 220 may have first through sixth surfaces 220*a* through 220*f*. The first surface 220*a* may be in direct contact with the support member 210, the second surface 220*b* may be disposed opposite to the first surface 220*a*, the third surface 220*c* may face the base 120, the fourth surface 220*d* may be disposed opposite to the third surface 220*c*, the fifth surface 220*e* may face the support member 210 without being in direct contact with the support member 210, and the sixth surface 220*f* may be disposed opposite to the fifth surface 220*e*.

The buffer portions 221 of each of the buffer members 220 may include airgaps. The airgaps of the buffer portions 221 may extend in the third direction D3. The airgaps of the buffer portions 221 may be formed as through holes penetrating the third and fourth surfaces 220*c* and 220*d*. For example, two buffer members 220 may be provided, and three airgaps may be formed in each of the buffer portions 221 of the buffer members 220. However, the number of airgaps formed in each of the buffer members 220 is not particularly limited. Also, cuboid airgaps are illustrated as being formed in each of the buffer members 220, but the shape of the airgaps of the buffer portions 221 of each of the buffer members 220 may vary. In another embodiment, cylindrical airgaps or airgaps in various other shapes may be formed in each of the buffer members 220.

In each of the buffer members 220, the buffer portions 221 may be completely surrounded by the pillar portions 222, the bonding portion 223, and the panel contact portion 224, in a plan view (as viewed in the third direction D3). For example, referring to FIG. 6, in each of the buffer members 220, the buffer portions 221 may be completely surrounded by the pillar portions 222, the bonding portion 223, and the panel contact portion 224, as viewed in the third direction D3, i.e., as viewed from above each of the buffer members 220.

In each of the buffer members 220, the airgaps of the buffer portions 221 may be disposed between the bonding portion 223 and the panel contact portion 224 in the first direction D1, in a cross-sectional view taken along the plane defined by the first and third directions D1 and D3. In another embodiment, in each of the buffer members 220, the airgaps of the buffer portions 221 may be disposed between the bonding portion 223 and the panel contact portion 224 in the second direction D2, in a cross-sectional view taken along the plane defined by the second and third directions D2 and D3. For example, referring to FIG. 8, in each of the buffer members 220, the airgaps of the buffer portions 221 may be disposed between the bonding portion 223 and the panel contact portion 224 in the first direction D1, in a cross-sectional view taken along line II-II' of FIG. 6. In a cross-sectional view taken along line II-II' of FIG. 6, the buffer portions 221 of each of the buffer members 220 may be spaced apart from the support member 210 by the bonding portions 223 of the buffer members 220.

The pillar portions 222 may be disposed between adjacent buffer portions 221 in the first or second direction D1 or D2. The pillar portions 222 may extend in the third direction D3.

In each of the buffer members 220, the pillar portions 222 may be surrounded by the buffer portions 221, the bonding portion 223, and the panel contact portion 224. For example, referring to FIG. 6, in each of the buffer members 220, the pillar portions 222 may be completely surrounded by the buffer portions 221, the bonding portion 223, and the panel contact portion 224, as viewed in the third direction D3, i.e., as viewed from above each of the buffer members 220.

In each of the buffer members 220, the pillar portions 222 may be disposed between the bonding portion 223 and the panel contact portion 224 in the first direction D1, in a cross-sectional view taken along the plane defined by the first and third directions D1 and D3. In another embodiment, in each of the buffer members 220, the pillar portions 222 may be disposed between the bonding portion 223 and the panel contact portion 224 in the second direction D2, in a cross-sectional view taken along the plane defined by the second and third directions D2 and D3. For example, referring to FIG. 8, in each of the buffer members 220, the pillar portions 222 may be disposed between the bonding portion 223 and the panel contact portion 224 in the first direction D1, in a cross-sectional view taken along line II-II' of FIG. 6. In a cross-sectional view taken along line II-II' of FIG. 6, the pillar portions 222 of each of the buffer members 220 may be spaced apart from the support member 210 by the bonding portions 223 of the buffer members 220.

In each of the buffer members 220, the bonding portion 223 and the panel contact portion 224 may extend in the first and third directions D1 and D3. In another embodiment, in each of the buffer members 220, the bonding portion 223 and the panel contact portion 224 may extend in the second and third directions D2 and D3. The bonding portions 223 of the buffer members 220 may be disposed adjacent to the support member 210, and the panel contact portions 224 of the buffer members 220 may be disposed on the opposite sides of the bonding portions 223 of the buffer members 220. A lateral side (e.g., the first surfaces 220*a*) of the bonding portions 223 of the buffer members 220 may be in direct contact with the support member 210. As a result, as the bonding area between the buffer members 220 and the support member 210 increases, the buffer members 220 may be firmly bonded to the support member 210.

Referring to FIG. 9, a thickness d3 of the panel contact portions 224 of the buffer members 220 may be less than a thickness d1 of the bonding portions 223 of the buffer members 220, but embodiments are not limited thereto. For example, the thickness d1 of the bonding portions 223 of the buffer members 220 may be in a range of about 0.5 mm to about 1.5 mm, and the thickness d3 of the panel contact portions 224 of the buffer members 220 may be in a range of about 1.0 mm to about 2.0 mm.

A thickness d2 of the airgaps of the buffer portions 221 of the buffer members 220 may be greater than the thicknesses d1 and d3. For example, the thickness d2 of the airgaps of the buffer portions 221 of the buffer members 220 may be in a range of about 1.5 mm to about 2.5 mm. As a result, as the airgaps of the buffer portions 221 of the buffer members 220 includes more air, the buffering effect of the buffer members 220 may be improved.

The slot part 200 may be formed by a mold manufacturing process. The support member 210 may be formed by injecting a material for forming the support member 210 into a mold, and the buffer members 220 may be formed by injecting a material for forming the buffer members 220 into the mold. During the formation of the support member 210 and the buffer members 220, pressure may be applied, or processes such as heat treatment may be performed. As already mentioned above, the support member 210 and the buffer members 220 may be bonded to each other and may thus be formed in one body. For example, the support member 210 and the buffer members 220 may be integrally formed by injection. Also, as already mentioned above, as the entire lateral side of the buffer members 220 is bonded to the support member 210, the bonding area of the buffer members 220 and the support member 210 increases, and thus, the buffer members 220 may be firmly bonded to the support member 210. Accordingly, no gaps may be included over the entire bonding surface between the support member 210 and each of the buffer members 220. As the support member 210 and the buffer members 220 are firmly bonded together with almost zero gaps therebetween, the mobility of the display panel DP may be effectively controlled.

In some embodiments, a synthetic resin having an excellent impact resistance and capable of being formed by injection molding or thermal molding, such as polycarbonate (PC), may be used as the material of the support member 210, and a material capable of performing a buffer function, such as urethane, may be used as the material of the buffer members 220.

The hardness of the support member 210 may be greater than the hardness of the buffer members 220. The hardness of a support member 210 formed of polycarbonate may be greater than the hardness of buffer members 220 formed of urethane. For example, the hardness of the support member 210 may be in a range of about 90 to about 100, and the hardness of the buffer members 220 may be in a range of about 70 to about 95. The term "hardness," as used herein, may be a Shore A hardness measurement obtained using a Shore A-type indenter. The support member 210 may be formed of a material that is relatively harder than the material of the buffer members 220 to prevent the mobility of the display panel DP and protect the display panel DP from external impact. On the contrary, the buffer member 220 may be formed of a material that is softer than the material of the support member 210 to reduce stress that may be caused upon direct contact with the display panel DP.

In some embodiments, the buffer members 220 may have a Shore-A hardness of in a range of about 80 to about 95. In case that the Shore-A hardness of the buffer members 220 is less than about 80, the amount of impact applied to the display panel DP may be reduced, and the stress applied to the display panel DP may be lowered. However, the buffer members 220 may be worn away due to their relatively low hardness, and as a result, a gap may be formed between the display panel DP and the slot part 200, and the mobility of the display panel DP may increase. Accordingly, in case that the hardness of the buffer members 220 is greater than or equal to about 80, the abrasion of the buffer members 220 may be prevented.

The buffer function of the slot part of FIG. 5 will hereinafter be described with reference to FIGS. 13 and 14.

Figure 13:
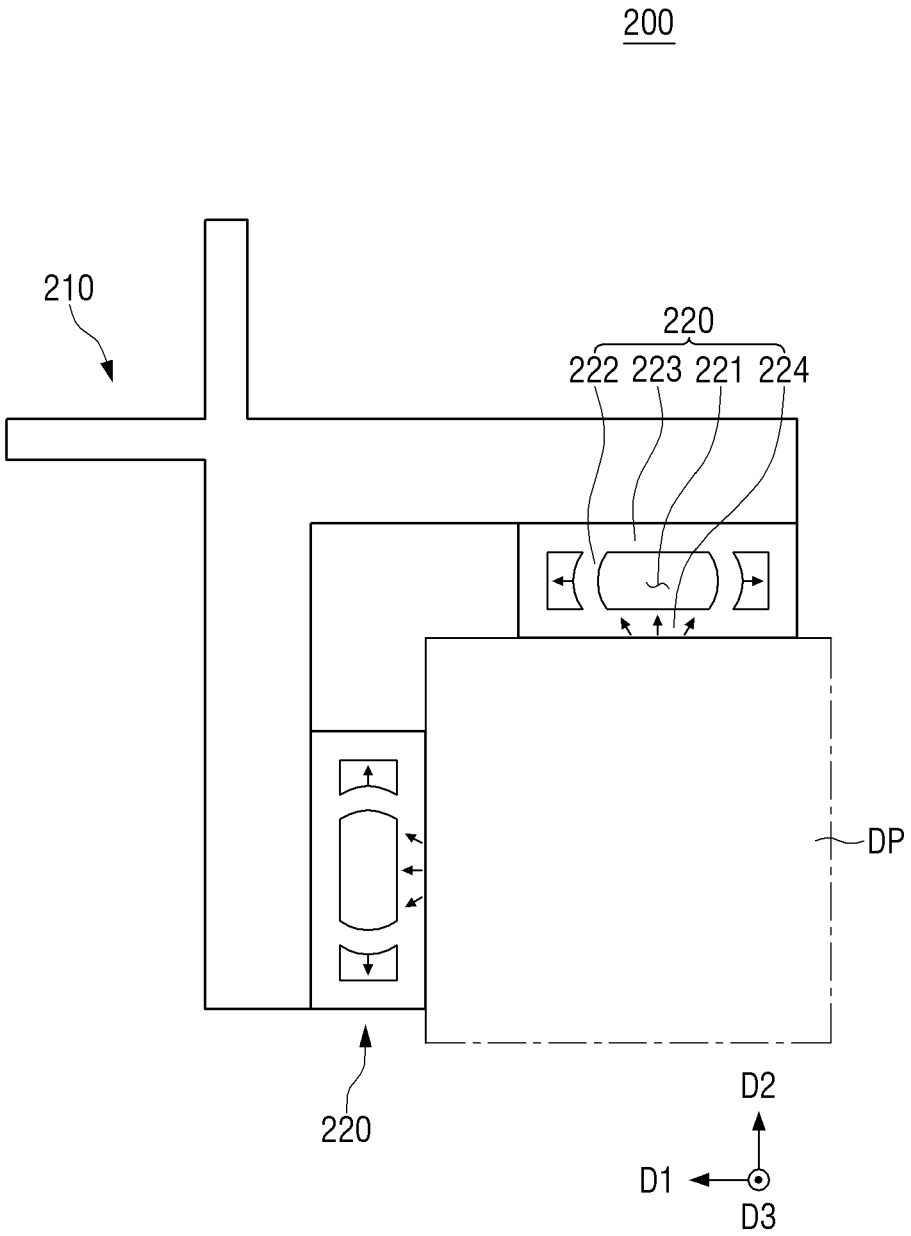
FIG. 13 is a plan view for explaining the buffer function of the slot part of FIG. 5.
Figure 14A:
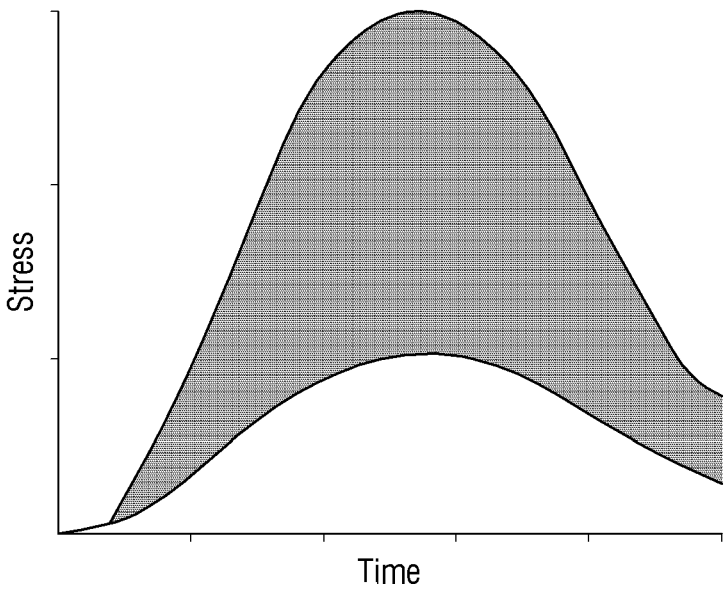
FIGS. 14A and 14B show graphs for explaining the buffer function of the slot part of FIG. 5.
Figure 14B:
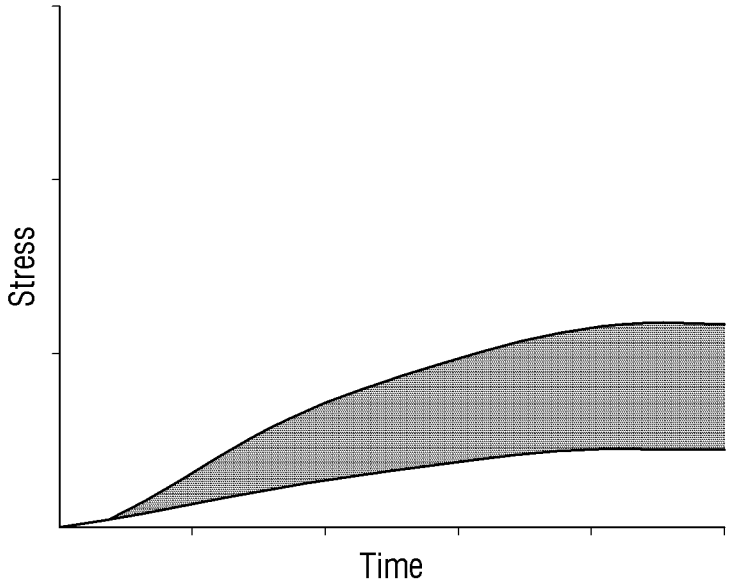

FIG. 13 is a plan view for explaining the buffer function of the slot part of FIG. 5, and FIGS. 14A and 14B show graphs for explaining the buffer function of the slot part of FIG. 5. FIG. 14A is a graph showing the level of stress applied to a display panel upon collision with a conventional buffer member having no buffer portions and no pillar portions, and FIG. 14B is a graph showing the level of stress applied to a display panel upon collision with a buffer member of the slot part of FIG. 5, i.e., a buffer member 220 having buffer portions 221 and pillar portions 222.

Referring to FIGS. 13, 14A, and 14B, the display panel DP may be in direct contact with the buffer member 220. For example, lateral sides of the display panel DP may be in direct contact with a second surface 220*b* of the buffer member 220. Thus, an impact may be transmitted to the buffer member 220 due to the mobility of the display panel DP. This impact may be transmitted to the display panel DP by a reaction, and as a result, stress may be applied to the display panel DP. As shown in FIG. 14B, the amount of impact applied to the display panel DP by a reaction may be reduced.

For example, the buffer member 220 may include the buffer portions 221 and the pillar portions 222. As the buffer portions 221 include airgaps, the amount of impact returned to the display panel DP by a reaction may be reduced. The pillar portions 221, which have elasticity, may be bent in a direction perpendicular to a force generated by the display panel DP and may thus distribute the force. For example, the pillar portions 222 may be bent in a direction perpendicular to the second surface 220*b* of the buffer member 220 and may thus reduce the amount of impact returned to the display panel DP by a reaction.

For example, as shown in FIG. 14A, in case that the conventional buffer member having no buffer portions and no pillar portions has a hardness of 80 or greater, the optical member 3 above the display panel DP may be detached from the upper substrate 2 or the seal member 4. On the contrary, as shown in FIG. 14B even in case that the buffer member 220 has a hardness of 80 or greater, the stress applied to the display panel DP may be reduced due to the buffer portions 221 and the pillar portions 222, and as a result, the detachment of the optical member 3 may be minimized or prevented.

The slot part 200 according to an embodiment of the disclosure may reduce the amount of impact returned to the display panel DP by a reaction. Also, as the amount of impact returned to the display panel DP by a reaction is reduced, the hardness of the buffer member 220 may be set relatively high, and thus, the abrasion of the buffer member 220 may be prevented.

Slot parts according to other embodiments of the disclosure will hereinafter be described, focusing on the differences with the slot part of FIG. 5.

Slot parts according to other embodiments of the disclosure will hereinafter be described with reference to FIGS. 15 through 19.

Figure 15:
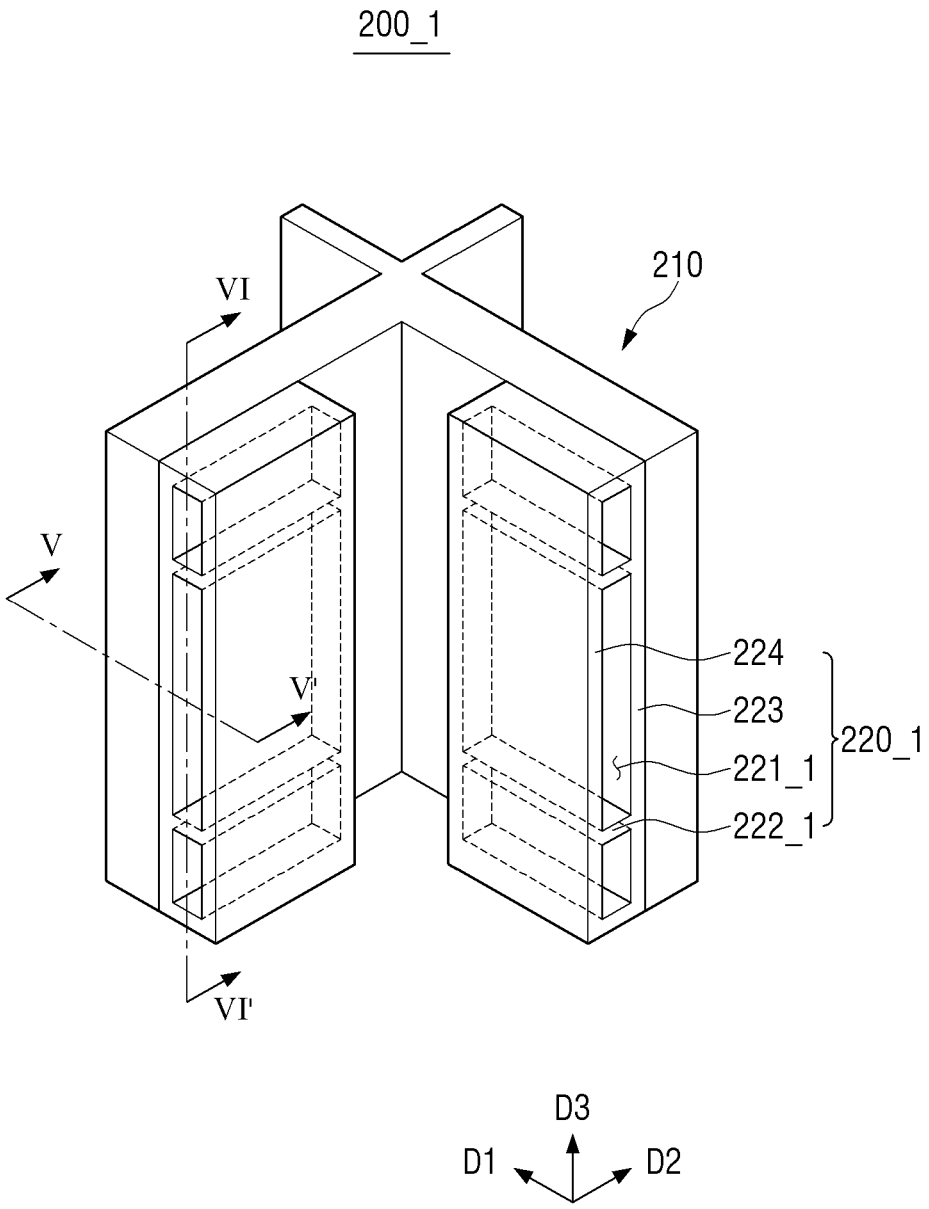
FIG. 15 is an enlarged perspective view of a slot part according to another embodiment of the disclosure.
Figure 16:
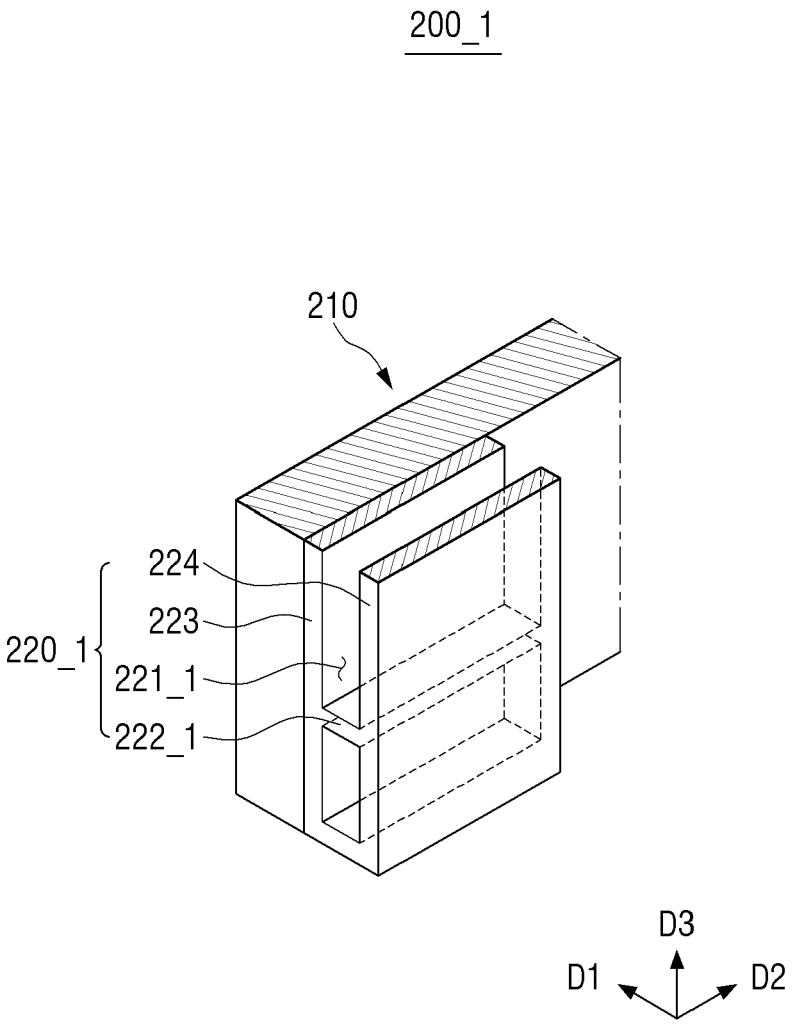
FIG. 16 is a schematic cross-sectional perspective view of the slot part of FIG. 15 taken along line V-V'.
Figure 17:
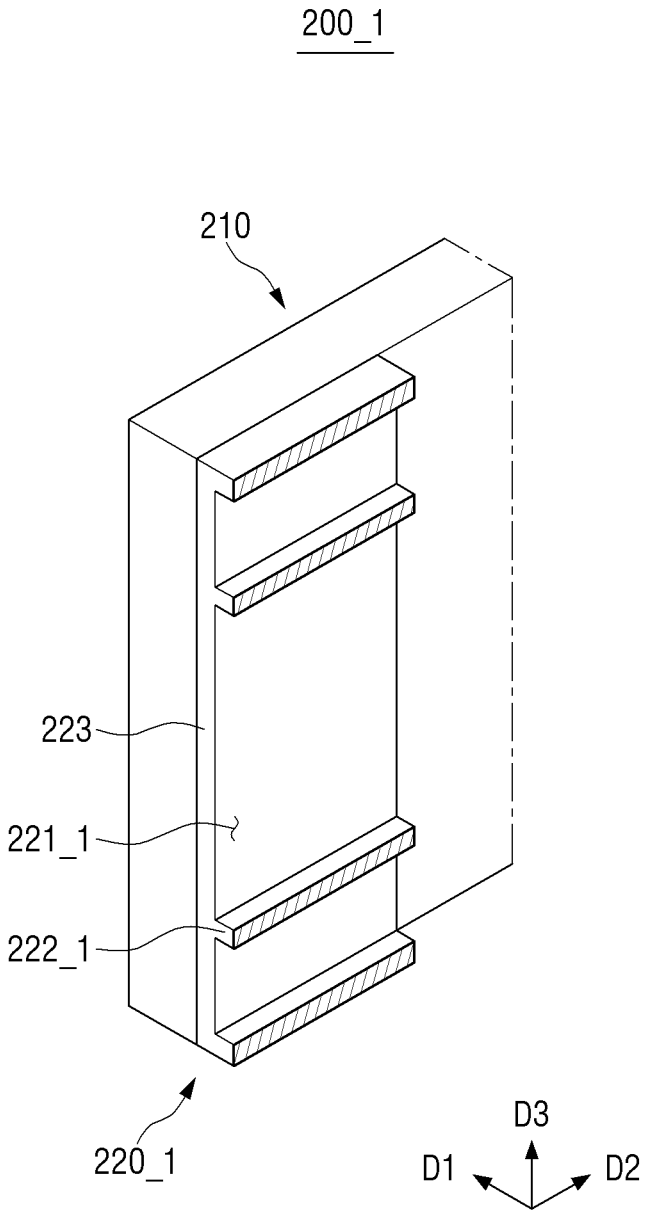
FIG. 17 is a schematic cross-sectional perspective view of the slot part of FIG. 15 taken along line VI-VI'.
Figure 18:
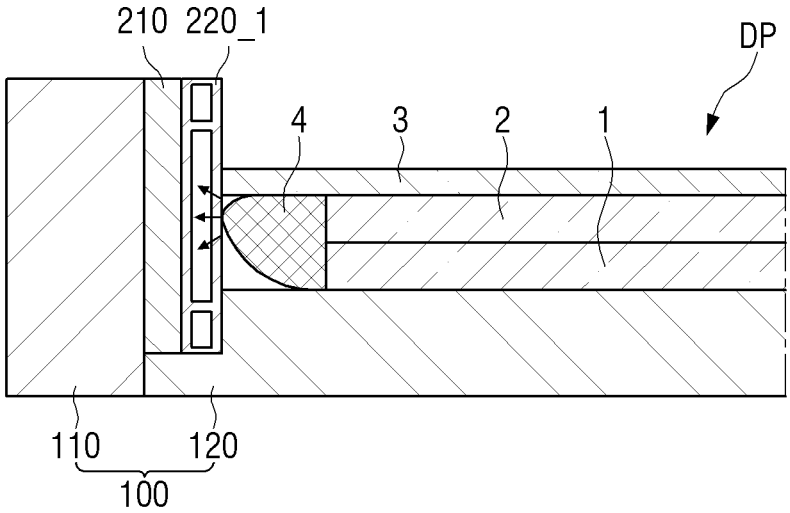
FIG. 18 is a schematic cross-sectional view of a tray for a display panel according to another embodiment of the disclosure.
Figure 19:
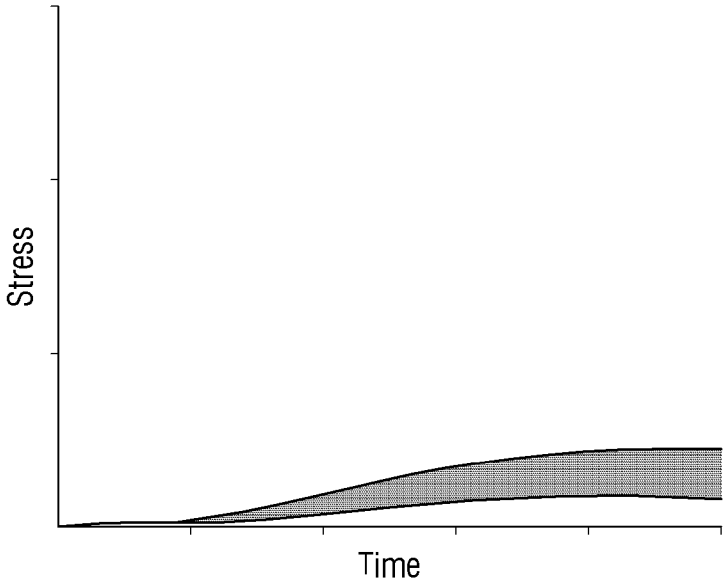
FIG. 19 is a graph for explaining the buffer function of the slot part of FIG. 15.

FIG. 15 is an enlarged perspective view of a slot part according to another embodiment of the disclosure. FIG. 16 is a schematic cross-sectional perspective view of the slot part of FIG. 15 taken along line V-V'. FIG. 17 is a schematic cross-sectional perspective view of the slot part of FIG. 15 taken along line VI-VI'. FIG. 18 is a schematic cross-sectional view of a tray for a display panel according to another embodiment of the disclosure. FIG. 19 is a graph for explaining the buffer function of the slot part according to another embodiment of the disclosure.

Referring to FIGS. 15 through 19, the slot part 200_1 is different from the slot part 200 of FIG. 6 in that the airgaps of the buffer portions 221_1 and the pillar portions 222_1 of each buffer member 220_1 extend in the first or second direction D1 or D2.

For example, the airgaps of the buffer portions 221_1 may extend in the first or second direction D1 or D2. The airgaps of the buffer portions 221_1 may be through holes penetrating a fifth or sixth surface 220*e* or 220*f* of each buffer member 220_1.

The buffer portions 221_1 may be completely surrounded by the pillar portions 2221, the bonding portion 223, and the panel contact portion 224, on a plane as viewed in the first or second direction D1 or D2. For example, referring to FIG. 15, the buffer portions 2211 may be surrounded by the pillar portions 2221, the bonding portion 223, and the panel contact portion 224, on a plane as viewed from the front of each buffer member 220_1.

The airgaps of the buffer portions 2211 may be disposed between the bonding portion 223 and the panel contact portion 224, in the first or second direction D1 or D2, on a plane defined by the first and second directions D1 and D2. For example, referring to FIG. 16, the airgaps of the buffer portions 221_1 may be disposed between the bonding portion 223 and the panel contact portion 224 in the first direction D1. The buffer portions 221_1 may be spaced apart from the support member 210 by the bonding portion 223, in a cross-sectional view taken along line V-V' of FIG. 15.

The pillar portions 222_1 may be disposed between the buffer portions 221_1 in the third direction D3. The pillar portions 222_1 may extend in the first or second direction D1 or D2.

The pillar portions 222_1 may be completely surrounded by the buffer portions 2211, the bonding portion 223, and the panel contact portion 224, on the plane as viewed in the first or second direction D1 or D2. For example, referring to FIG. 15, the pillar portions 2221 may be completely surrounded by the buffer portions 2211, the bonding portion 223, and the panel contact portion 224, as viewed in the first or second direction D1 or D2, i.e., as viewed from the front or from a side of each buffer member 220_1.

The pillar portions 222_1 may be disposed between the bonding portion 223 and the panel contact portion 224 in the first or second direction D1 or D2, in a cross-sectional view taken along the plane defined by the first and second directions D1 and D2. The pillar portions 222_1 may be spaced apart from the support member 210 by the bonding portion 223, in a cross-sectional view taken along the plane defined by the first and second directions D1 and D2. For example, referring to FIG. 16, the pillar portions 222_1 may be disposed between the bonding portion 223 and the panel contact portion 224 in the first direction D1. The pillar portions 222_1 may be spaced apart from the support member 210 by the bonding portion in the first direction D1.

Referring to FIG. 18, the pillar portions 222_1 of the buffer member 220_1 of the tray 1000_1 may be arranged to be offset from a display panel DP in the lateral direction of the display panel DP. Accordingly, as a force applied from the display panel DP is not transferred perpendicularly to the pillar portions 2221, the stress applied to the display panel DP may be reduced, as shown in FIG. 19.

A slot part according to another embodiment of the disclosure will hereinafter be described with reference to FIGS. 20 and 21.

Figure 20:
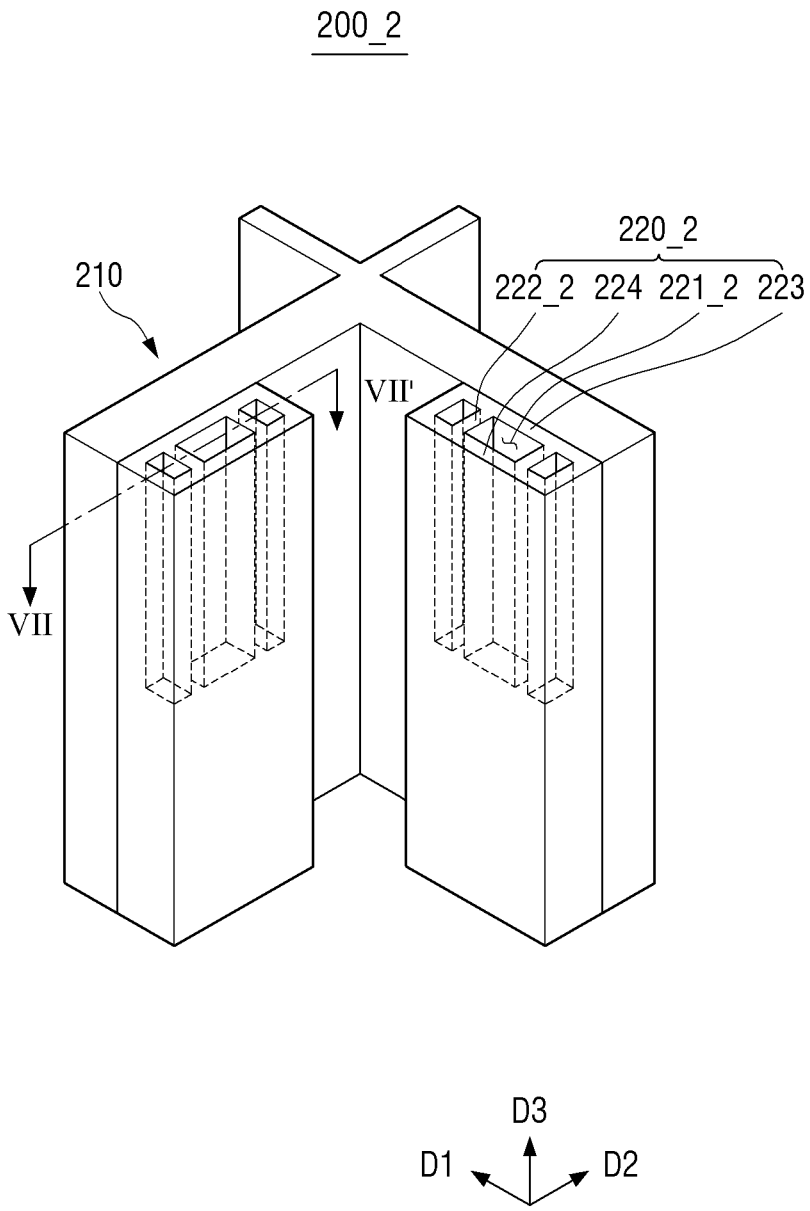
FIG. 20 is an enlarged perspective view of a slot part according to another embodiment of the disclosure.

FIG. 20 is an enlarged perspective view of a slot part according to another embodiment of the disclosure. FIG. 21 is a schematic cross-sectional perspective view of the slot part of FIG. 20 taken along line VII-VII'.

Figure 21:
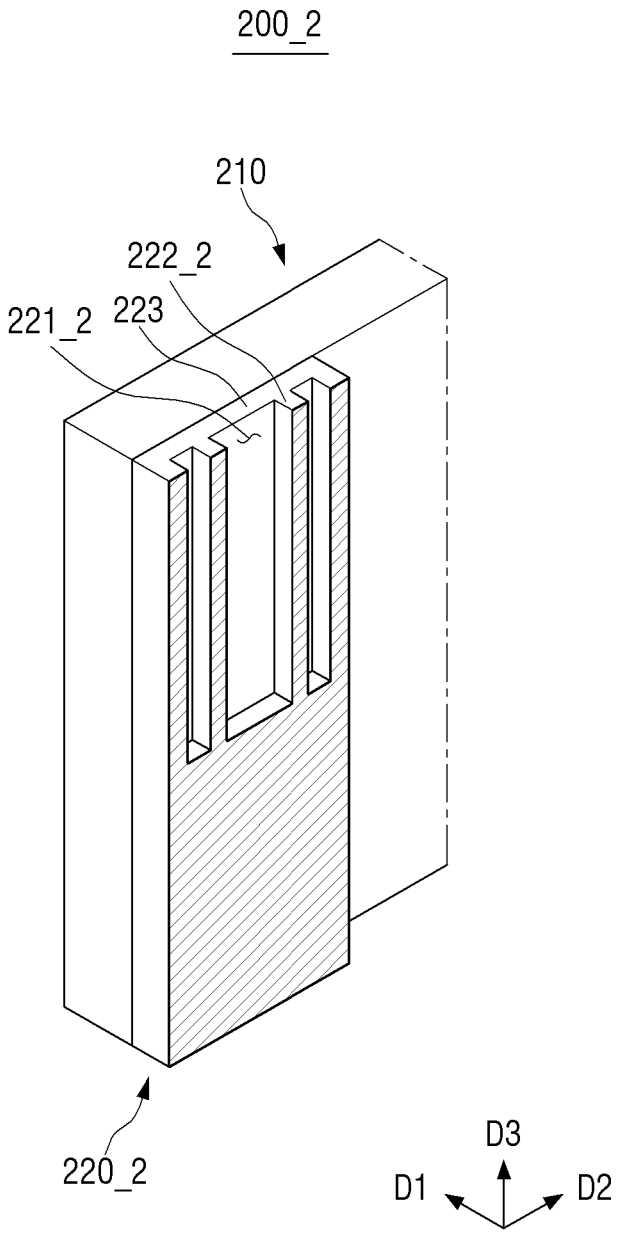
FIG. 21 is a schematic cross-sectional perspective view of the slot part of FIG. 20 taken along line VII-VII'.

Referring to FIGS. 20 and 21, the slot part 200_2 is different from the slot part 200 of FIG. 6 in that the airgaps of the buffer portions 221_2 of each buffer member 220_2 are formed as pockets, not as through holes.

For example, the airgaps of the buffer portions 221_2 may be pocket-type airgaps penetrating the fourth surface 220*d* of each buffer member 220_2, but not penetrating the third surface 220*c* of each buffer member 220_2. First ends of the buffer portions 221_2 may be disposed on the fourth surface 220*d*, and second ends of the buffer portions 221_2 may be disposed in the buffer member 220_2. The pillar portion 2222 may be disposed between the buffer portions 221_2. As the airgaps of the buffer portions 221_2 are formed as pocket-type airgaps penetrating a surface, but not another surface, of each buffer member 220_2, the structure of a mold for forming the slot part 200_2 may be simplified, and the amount of impact may be controlled by controlling the size of the airgaps of the buffer portions 221_2.

A slot part according to another embodiment of the disclosure will hereinafter be described with reference to FIGS. 22 and 23.

Figure 22:
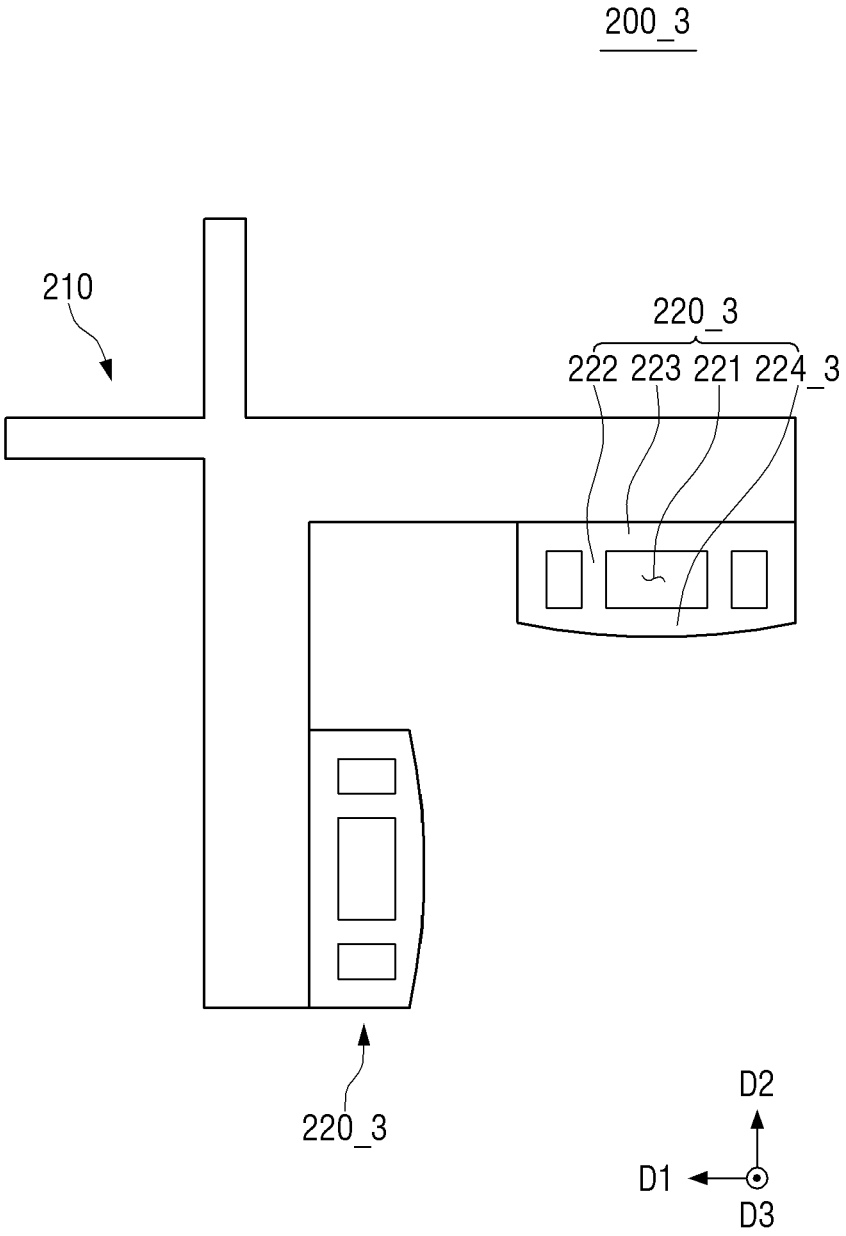
FIG. 22 is a plan view of a slot part according to another embodiment of the disclosure.

FIG. 22 is a plan view of a slot part according to another embodiment of the disclosure. FIG. 23 is a plan view for explaining the buffer function of the slot part of FIG. 22.

Figure 23:
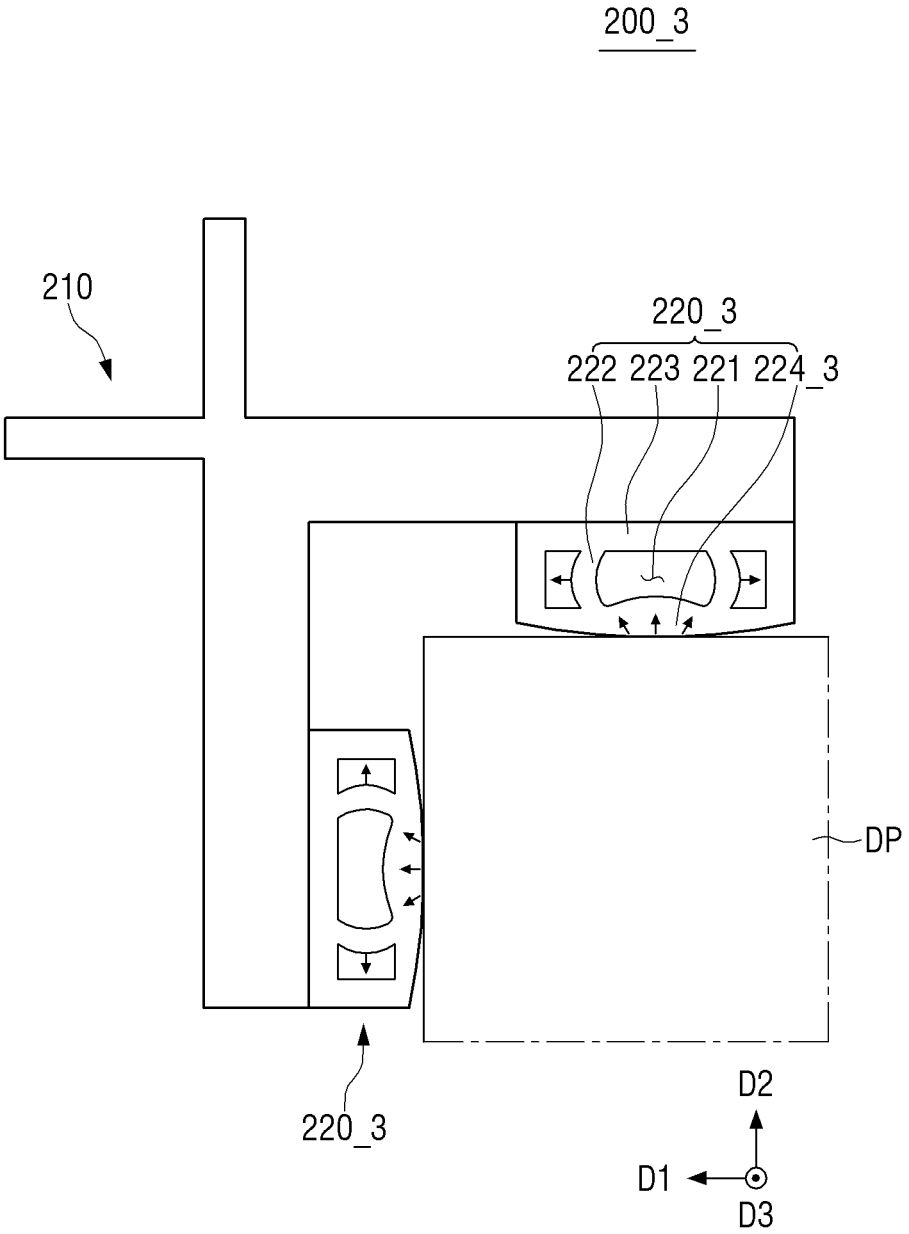
FIG. 23 is a plan view for explaining the buffer function of the slot part of FIG. 22.

Referring to FIGS. 22 and 23, the slot part 200_3 is different from the slot part 200 of FIG. 6 in that the panel contact portion 224_3 of each buffer member 220_3 has a convex shape.

For example, the panel contact portion 224_3 of each buffer member 220_3 may have a convex shape in a plan view. For example, the second surface 220*b* of each buffer member 220_3 may not be flat, and may be convex.

As illustrated in FIG. 23, a display panel DP may contact a most protruding part of the second surface 220*b*, which is convex, and then portions adjacent to the most protruding part of the second surface 220*b*.

In case that a force is transferred perpendicularly to the buffer member 2203, the force may be distributed to the buffer member in other directions. Accordingly, the amount of impact returned to the display panel DP by a reaction may be reduced.

By controlling the curvature of the second surface 220*b* of each buffer member 220_3 or the locations of pillar portions 222, the display panel DP may not directly contact the buffer member 220_3 in areas overlapping the pillar portions 222 in the first or second direction D1 or D2.

As the display panel DP does not directly contact the buffer member 220_3 in the areas overlapping the pillar portions 222, a force may not be perpendicularly applied by the display panel DP to the pillar portions 222, and as a result, the stress applied to the display panel DP may be reduced.

A slot part according to another embodiment of the disclosure will hereinafter be described with reference to FIGS. 24 and 25.

Figure 24:
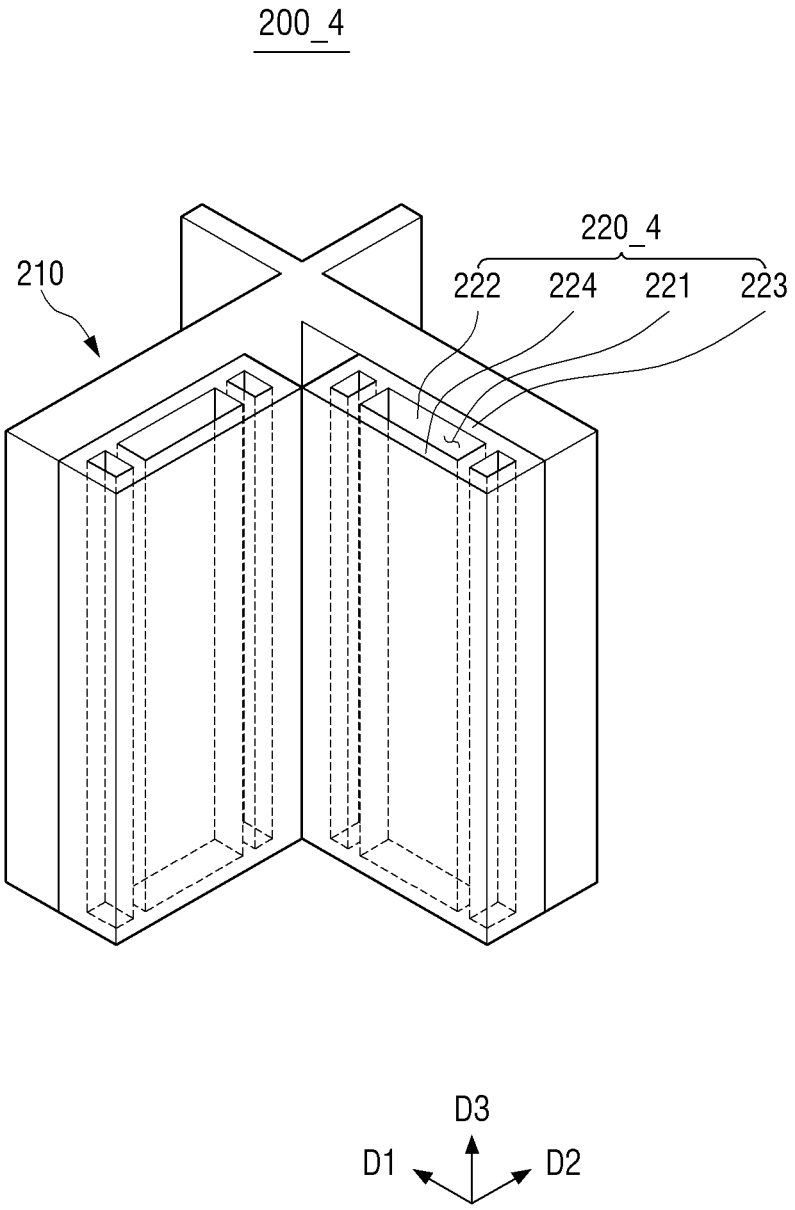
FIG. 24 is a perspective view of a slot part according to another embodiment of the disclosure.

FIG. 24 is a perspective view of a slot part according to another embodiment of the disclosure. FIG. 25 is a plan view of the slot part of FIG. 24.

Figure 25:
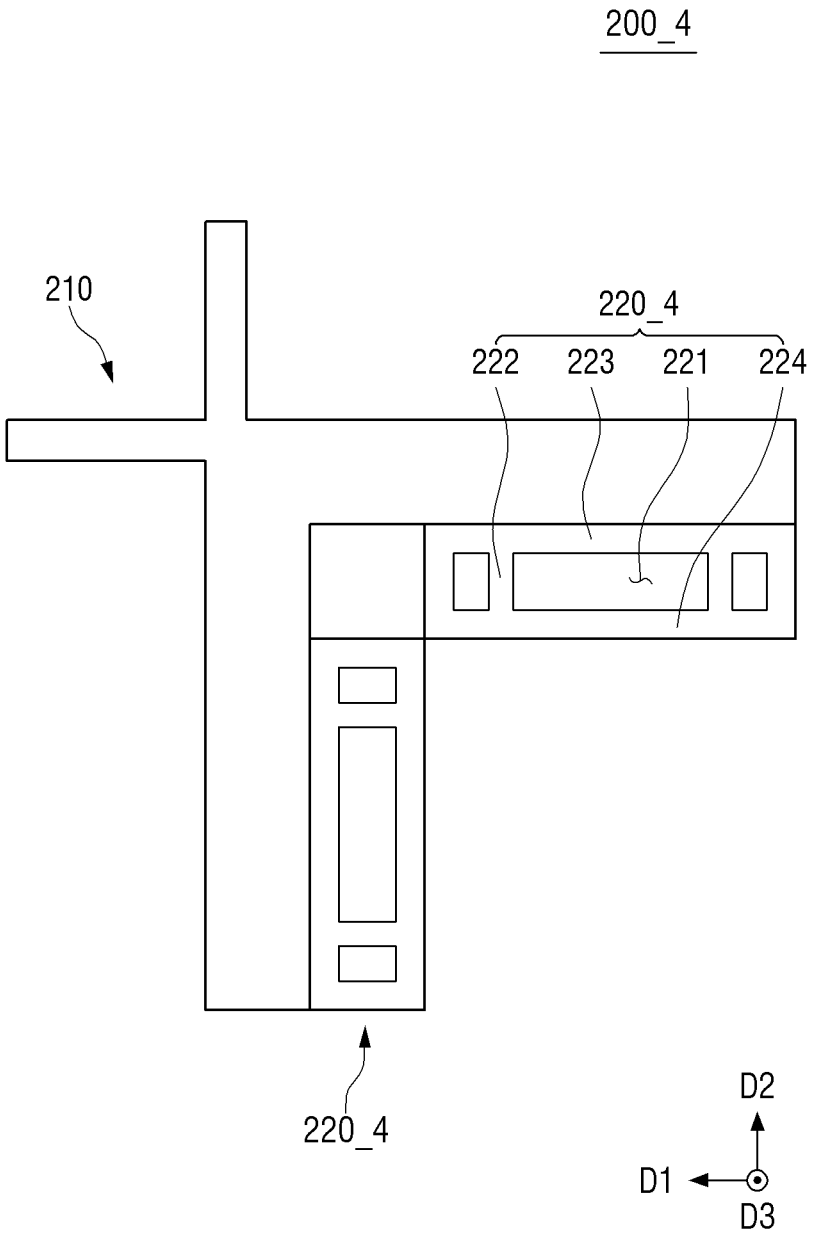
FIG. 25 is a plan view of the slot part of FIG. 24.

Referring to FIGS. 24 and 25, the slot part 200_4 is different from the slot part 200 of FIG. 6 in that edges of the buffer members 220_4 contact with each other.

For example, an edge of the buffer member 220_4 on the first support portion 211*a* and an edge of the buffer member 220_4 on the second support portion 211*b* may contact each other. Accordingly, as the areas of contact between the buffer member 220_4 and the first support portion 211*a* and between the buffer member 220_4 and the second support portion 211*b* increase, the first and second support portions 211*a* and 211*b* may be further firmly bonded to the buffer members 220_4. Also, as the slot part 200_4 completely covers even the corners of a display panel DP, the mobility of the display panel DP may be further reduced.

Slot parts according to other embodiments of the disclosure will hereinafter be described with reference to FIGS. 26 through 29.

Figure 26:
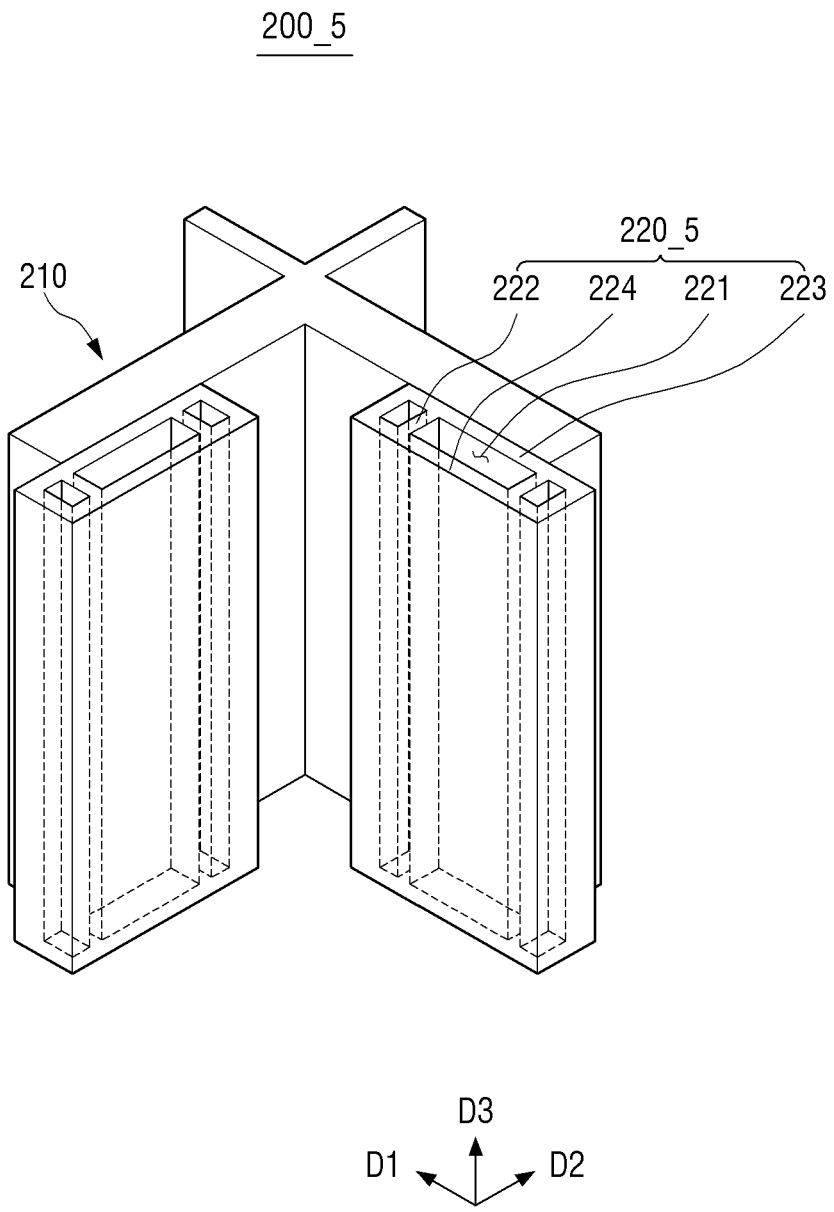
FIG. 26 is a perspective view of a slot part according to another embodiment of the disclosure.
Figure 27:
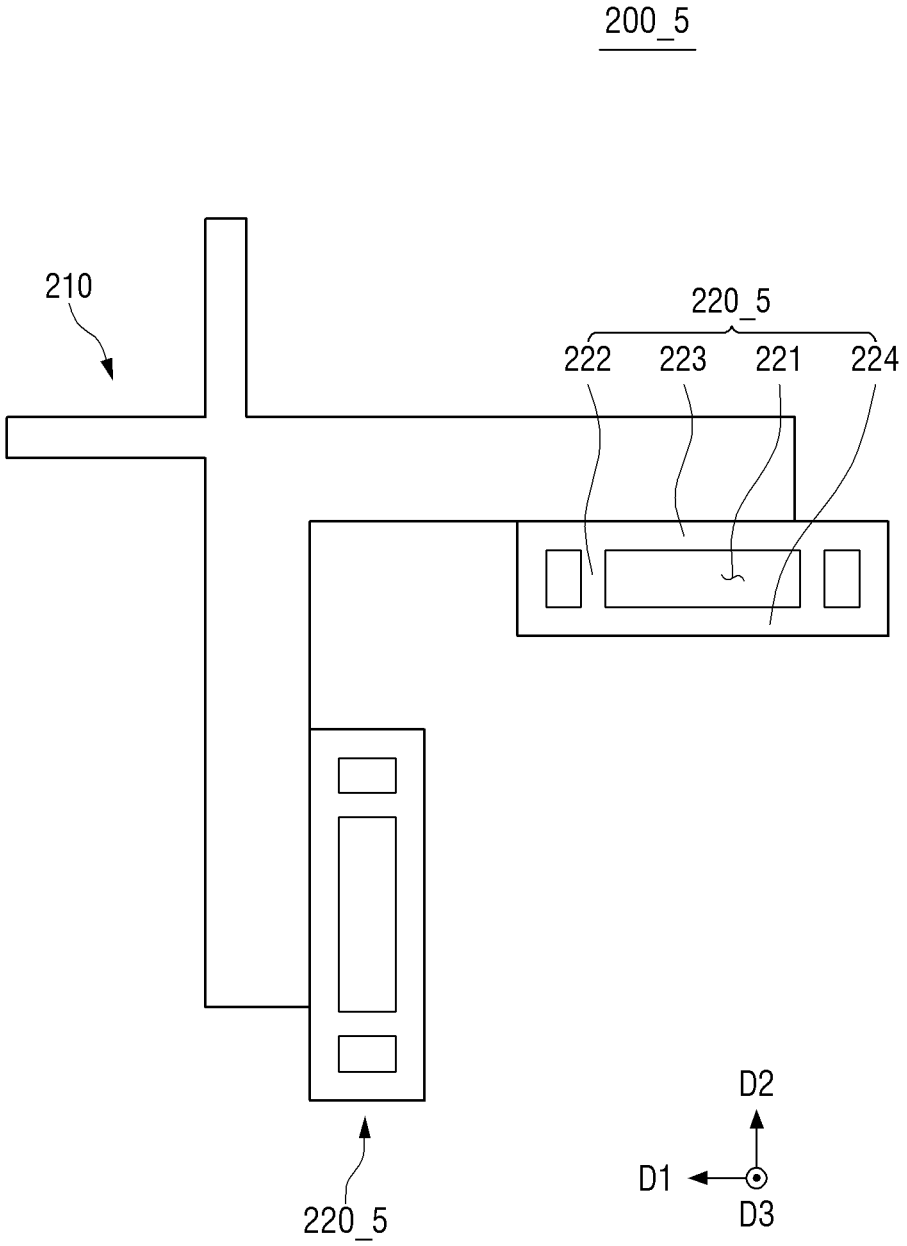
FIG. 27 is a plan view of the slot part of FIG. 26.
Figure 28:
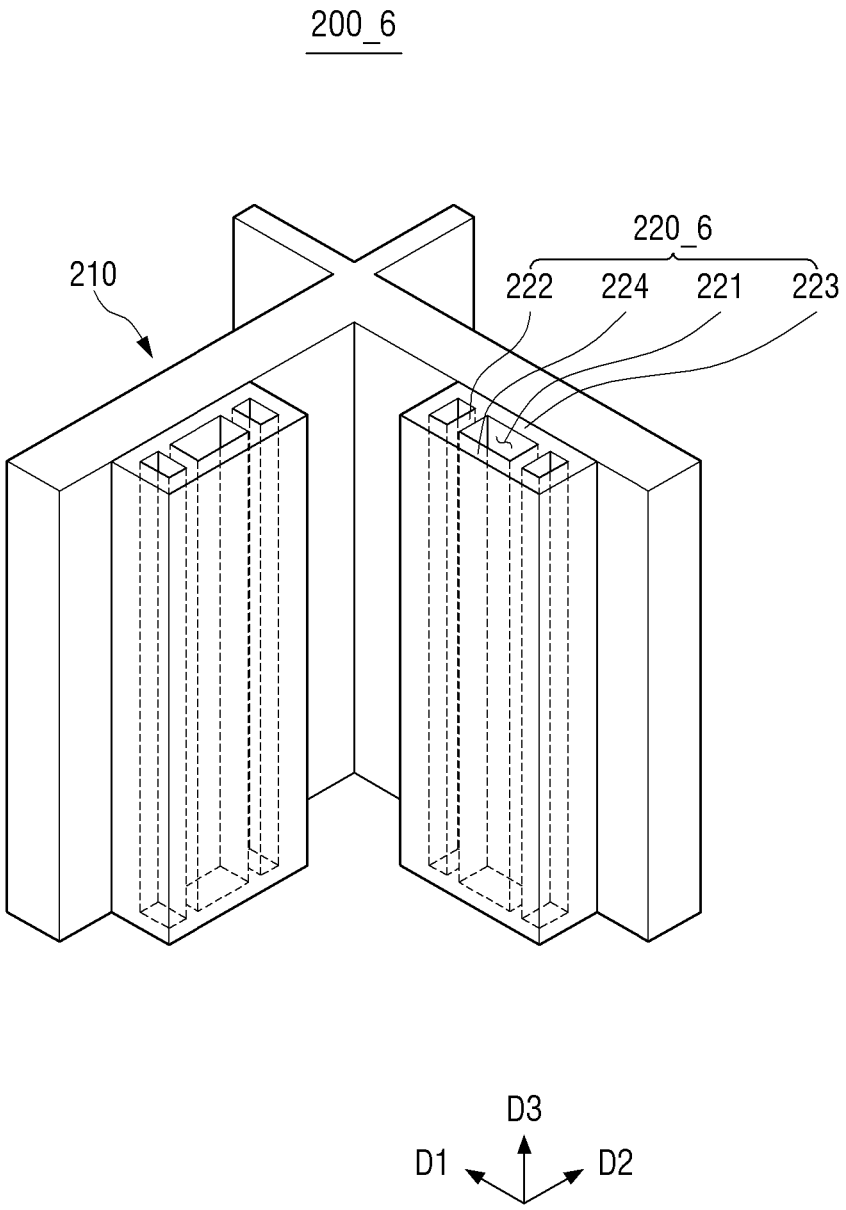
FIG. 28 is a perspective view of a slot part according to another embodiment of the disclosure.
Figure 29:
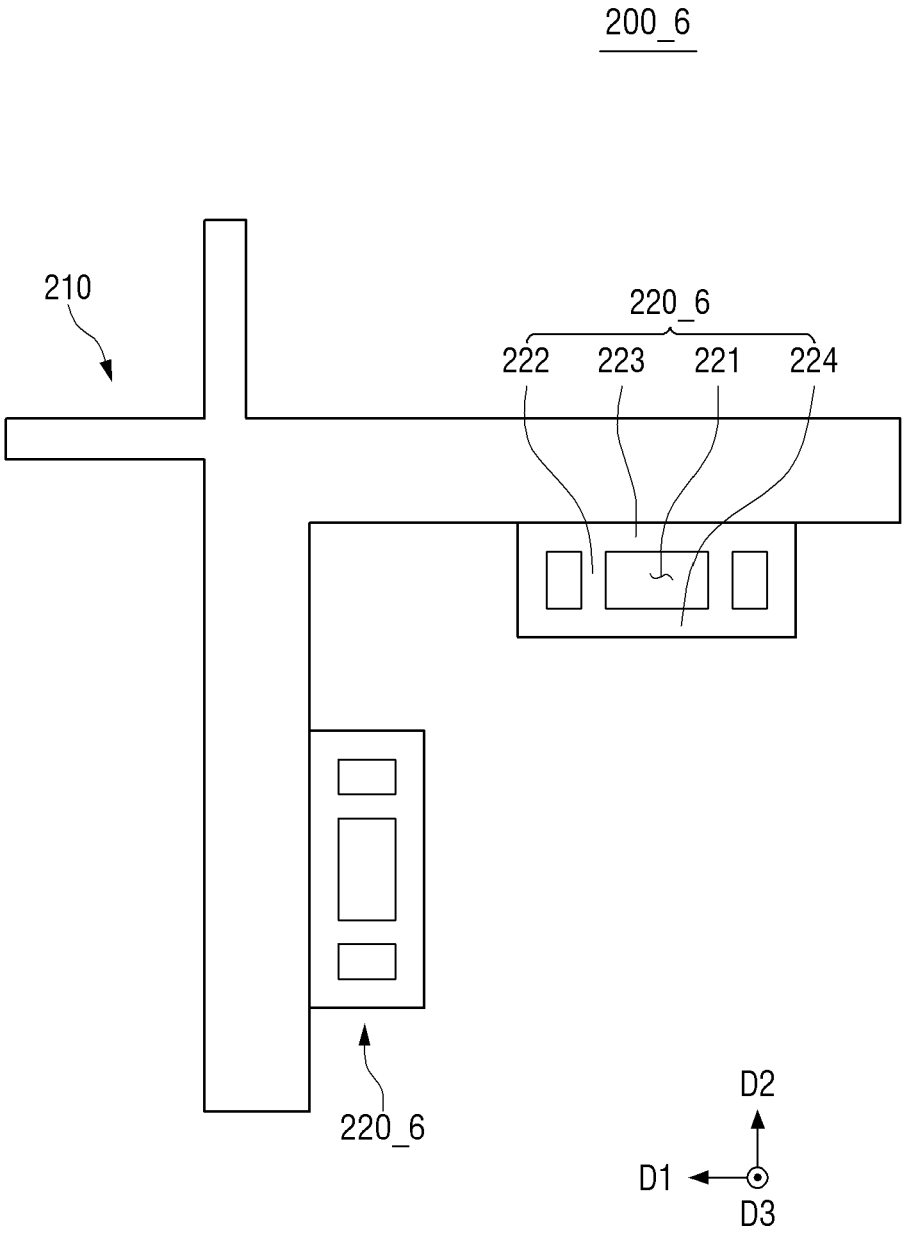
FIG. 29 is a plan view of the slot part of FIG. 28.

FIG. 26 is a perspective view of a slot part according to another embodiment of the disclosure. FIG. 27 is a plan view of the slot part of FIG. 26. FIG. 28 is a perspective view of a slot part according to another embodiment of the disclosure. FIG. 29 is a plan view of the slot part of FIG. 28.

Referring to FIGS. 26 and 27, the slot part 200_5 is different from the slot part 200 of FIG. 6 in that the buffer members 2205 protrude beyond the support member 210 in the first or second direction D1 or D2. Referring to FIGS. 28 and 29, the slot part 200_6 is different from the slot part 200 of FIG. 6 in that the support member 210 protrude beyond the buffer members 220_6 in the first or second direction D1 or D2.

The above description is an example of technical features of the disclosure, and those skilled in the art to which the disclosure pertains will be able to make various modifications and variations. Therefore, the embodiments of the disclosure described above may be implemented separately or in combination with each other.

Therefore, the embodiments disclosed in the disclosure are not intended to limit the technical spirit of the disclosure, but to describe the technical spirit of the disclosure, and the scope of the technical spirit of the disclosure is not limited by these embodiments.

What is claimed is:

1. A tray for a display panel, comprising:

a body part including a base and an outer wall surrounding the base; and a slot part including a support member extending in a first direction and a second direction intersecting the first direction, and one or more buffer members disposed on an inner lateral side of the support member, wherein a buffer member of the one or more buffer members includes a plurality of buffer portions, each including a corresponding airgap, and a plurality of pillar portions, each disposed between adjacent buffer portions of the plurality of buffer portions, the buffer member includes:

a first surface, which faces and is in contact with the inner lateral side of the support member;

a second surface, which opposes the first surface;

a third surface, which is different from the first and second surfaces; and a fourth surface, which opposes the third surface, the second surface has a convex shape protruding laterally away from the inner lateral side of the support member, and the corresponding airgaps are formed of pocket-type airgaps extending in a direction from the third surface to the fourth surface, penetrating the fourth surface, and not penetrating the third surface.

2. The tray of claim 1, wherein, in a case that the display panel is supported by the tray at least via the buffer member, a portion of the buffer member overlapping the plurality of pillar portions in the first direction or the second direction does not directly contact the display panel.

3. The tray of claim 1, wherein the support member includes a first support portion extending in the first direction and a second support portion extending in the second direction and intersecting the first support portion, and the buffer member comprises a first buffer member disposed on an inner lateral side of the first support portion and a second buffer member disposed on an inner lateral side of the second support portion.

4. A tray for a display panel, comprising:

a body part including a base and an outer wall surrounding the base; and a slot part including a support member extending in a first direction and a second direction intersecting the first direction, and a buffer member disposed on an inner lateral side of the support member, wherein the buffer member includes:

a first surface, which faces and is in contact with the inner lateral side of the support member;

a second surface, which opposes the first surface;

a third surface, which is different from the first and second surfaces;

a fourth surface, which opposes the third surface;

a plurality of buffer portions, each including a corresponding airgap; and a plurality of pillar portions, each disposed between adjacent buffer portions of the plurality of buffer portions, each of the plurality of buffer portions and the plurality of pillar portions extends in a third direction intersecting the first and second directions, the corresponding airgaps are formed of pocket-type airgaps extending in a direction from the third surface to the fourth surface, penetrating the fourth surface, and not penetrating the third surface, and the buffer member is integrally bonded to the support member.

5. The tray of claim 4, wherein an entire area of the first surface contacts the support member.

6. The tray of claim 4, wherein a hardness of the support member is greater than a hardness of the buffer member.

7. The tray of claim 6, wherein a Shore-A hardness of the buffer member is in a range of about 80 to about 95.

8. The tray of claim 7, wherein the support member includes polycarbonate, and the buffer member includes urethane.

9. The tray of claim 4, wherein the body part further includes a receiving area that receives the display panel, and the receiving area is disposed on the base inside of inner lateral sides of the outer wall in a view in the third direction.

* * * * *